US011211718B2

(12) United States Patent
Ueda

(10) Patent No.: US 11,211,718 B2
(45) Date of Patent: Dec. 28, 2021

(54) RADIO FREQUENCY MODULE AND COMMUNICATION DEVICE

(71) Applicant: Murata Manufacturing Co., Ltd., Kyoto (JP)

(72) Inventor: Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 12 days.

(21) Appl. No.: 16/898,799

(22) Filed: Jun. 11, 2020

(65) Prior Publication Data

US 2020/0303833 A1 Sep. 24, 2020

Related U.S. Application Data

(63) Continuation of application No. PCT/JP2018/044605, filed on Dec. 4, 2018.

(30) Foreign Application Priority Data

Dec. 12, 2017 (JP) ..... JP2017-237687

(51) Int. Cl.
*H01Q 21/06* (2006.01)
*H01Q 21/24* (2006.01)
(Continued)

(52) U.S. Cl.
CPC ..... *H01Q 21/065* (2013.01); *H01Q 3/36* (2013.01); *H01Q 15/24* (2013.01);
(Continued)

(58) Field of Classification Search
CPC ..... H01Q 1/2283; H01Q 1/38; H01Q 21/065; H01Q 21/245; H01Q 21/06; H01Q 21/061;
(Continued)

(56) References Cited

U.S. PATENT DOCUMENTS 5,223,848 A 6/1993 Rammos et al.
7,379,759 B2 * 5/2008 Nakaya ..... H01Q 3/26 455/103
(Continued)

FOREIGN PATENT DOCUMENTS

DE 102007060083 A1 6/2009
JP H0297104 A 4/1990
(Continued)

OTHER PUBLICATIONS

International Search Report issued in Application No. PCT/JP2018/044605, dated Feb. 19, 2019.
(Continued)

*Primary Examiner* — Vibol Tan
(74) *Attorney, Agent, or Firm* — Pearne & Gordon LLP

(57) ABSTRACT

An array antenna includes a plurality of first patch antennas configured to radiate a polarized wave in an X direction at a first operating frequency and configured to radiate a polarized wave in a Y direction at a second operating frequency higher than the first operating frequency, and a plurality of second patch antennas configured to radiate a polarized wave in the Y direction at the first operating frequency and configured to radiate a polarized wave in the X direction at the second operating frequency. When a distance between any one of the first patch antennas and another one of the first patch antennas closest to the any one first patch antenna is defined as D1, and a distance between any one of the first patch antennas and the second patch antenna closest to the any one first patch antenna is defined as D2, D1>D2 is satisfied.

20 Claims, 16 Drawing Sheets

(51) Int. Cl.
*H01Q 15/24* (2006.01)
*H01Q 3/36* (2006.01)
*H01Q 23/00* (2006.01)

(52) U.S. Cl.
CPC ..... *H01Q 15/242* (2013.01); *H01Q 21/245* (2013.01); *H01Q 23/00* (2013.01)

(58) Field of Classification Search
CPC ..... H01Q 21/062; H01Q 23/00; H01Q 3/28; H01Q 3/36; H01Q 9/0407; H01Q 21/29; H01Q 15/0026; H01Q 15/242; H01Q 15/24
See application file for complete search history.

(56) References Cited

U.S. PATENT DOCUMENTS

| | | | | |
|---|---|---|---|---|
| 9,379,434 | B2 * | 6/2016 | Sato | H01Q 1/525 |
| 10,777,882 | B2 * | 9/2020 | Cho | H01Q 21/065 |
| 10,985,455 | B2 * | 4/2021 | Keyrouz | H01Q 1/523 |
| 2010/0260076 | A1 | 10/2010 | Corman et al. | |
| 2018/0145400 | A1 | 5/2018 | Gabriel et al. | |
| 2018/0205358 | A1 | 7/2018 | Onaka et al. | |
| 2020/0176892 | A1 * | 6/2020 | Wang | H01Q 1/246 |

FOREIGN PATENT DOCUMENTS

| | | | |
|---|---|---|---|
| JP | H02116202 | A | 4/1990 |
| JP | H0541608 | A | 2/1993 |
| JP | H06224628 | A | 8/1994 |
| JP | H1168448 | A | 3/1999 |
| JP | 2012523803 | A | 10/2012 |
| JP | 2013207522 | A | 10/2013 |
| WO | 2016173713 | A1 | 11/2016 |
| WO | 2017047199 | A1 | 3/2017 |
| WO | 2017088090 | A1 | 6/2017 |

OTHER PUBLICATIONS

Written Opinion issued in Application No. PCT/JP2018/044605, dated Feb. 19, 2019.
R. Shamsaee Malfajani, et al., "Dual-Band Orthogonally Polarized Single-Layer Reflectarray Antenna," IEEE Transactions on Antennas and Propagation, vol. 65, No. 11, Sep. 19, 2017.

* cited by examiner

RADIO FREQUENCY MODULE AND COMMUNICATION DEVICE

This is a continuation of International Application No. PCT/JP2018/044605 filed on Dec. 4, 2018 which claims priority from Japanese Patent Application No. 2017-237687 filed on Dec. 12, 2017. The contents of these applications are incorporated herein by reference in their entireties.

BACKGROUND OF THE DISCLOSURE

Field of the Disclosure

The present disclosure relates to a radio frequency module and a communication device suitable for use for radio frequency signals such as microwaves, millimeter waves, and the like.

Description of the Related Art

As a radio frequency module to be used for a radio frequency signal, there has been known a radio frequency module including a plurality of radiating elements (see, for example, Patent Documents 1 and 2). Patent Document 1 discloses a configuration in which a plurality of first radiating elements configured to radiate a radio wave of a first frequency and a plurality of second radiating elements configured to radiate a radio wave of a second frequency are provided, and these are arranged in a matrix shape (lattice shape). Patent Document 2 discloses a configuration including a plurality of patch antennas that radiates two polarized waves orthogonal to each other.

Patent Document 1: Japanese Unexamined Patent Application Publication No. 2-97104

Patent Document 2: Japanese Unexamined Patent Application Publication No. 5-41608

BRIEF SUMMARY OF THE DISCLOSURE

Incidentally, FIG. 1 in Patent Document 1 discloses a configuration in which both the first radiating element and the second radiating element radiate the same polarized waves (for example, vertically polarized waves). In this case, although a vertically polarized wave may be radiated, a horizontally polarized wave may not be radiated.

In addition, FIG. 3 in Patent Document 1 discloses a configuration in which a direction of a polarized wave of the first radiating element and a direction of a polarized wave of the second radiating element are orthogonal to each other. However, in this case, when the first radiating element radiates a vertically polarized wave of a first frequency, it is impossible to radiate a horizontally polarized wave of the first frequency. Similarly, when the second radiating element radiates a horizontally polarized wave of a second frequency, it is impossible to radiate a vertically polarized wave of the second frequency.

On the other hand, FIG. 9 in Patent Document 2 discloses a configuration in which each patch antenna is provided with two routes of feeder lines orthogonal to each other and is given phases by lengths of wirings to operate as a circularly polarized wave array. This configuration is known as a method in which deterioration in axial ratio of each patch antenna is canceled out as an array and the axial ratio is maintained. However, in this case, when a frequency changes, a phase difference between the respective patch antennas is not an ideal excitation condition. Therefore, an axial ratio may be kept good, but a gain or the like exhibits narrow band characteristics as a result. Further, a phase difference may not be provided between the elements, and the elements cannot operate as a phased array.

The present disclosure has been made in view of the above-mentioned problems of the related art, and an object of the present disclosure is to provide a radio frequency module and a communication device capable of operating as a phased array, capable of radiating radio waves of a plurality of frequencies, and capable of radiating radio waves of polarized waves of at least two directions at one frequency.

To solve the above-mentioned problems, the present disclosure provides a radio frequency module including a multilayer dielectric substrate, an RFIC connected to the multilayer dielectric substrate and having a plurality of RF input/output terminals, and an array antenna placed on or in the multilayer dielectric substrate and configured with a plurality of polarized wave sharing antennas configured to radiate polarized waves in X and Y directions orthogonal to each other, in which the RFIC includes at least a switching unit configured to switch ON and OFF states of input or output of an RF signal and a variable phase shifter for each of the plurality of RF input/output terminals, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a polarized wave in the X direction at a first operating frequency and configured to radiate a polarized wave in the Y direction at a second operating frequency higher than the first operating frequency, and a plurality of second polarized wave sharing antennas configured to radiate a polarized wave in the Y direction at the first operating frequency and configured to radiate a polarized wave in the X direction at the second operating frequency, the first polarized wave sharing antennas are arranged in a matrix shape such that each two of the first polarized wave sharing antennas adjacent to each other have intervals in the X and Y directions that are equal to or shorter than a free space wave length with respect to the second operating frequency, the second polarized wave sharing antennas are arranged in a matrix shape such that each two of the second polarized wave sharing antennas adjacent to each other have intervals in the X and Y directions that are equal to or shorter than a free space wave length with respect to the second operating frequency, and when a distance between any one of the first polarized wave sharing antennas and another one of the first polarized wave sharing antennas closest to the any one first polarized wave sharing antenna is defined as D1, and a distance between any one of the first polarized wave sharing antennas and the second polarized wave sharing antenna closest to the any one first polarized wave sharing antenna is defined as D2, D1>D2 is satisfied.

Further, another disclosure provides a radio frequency module including a multilayer dielectric substrate, an RFIC connected to the multilayer dielectric substrate and having a plurality of RF input/output terminals, and an array antenna placed in or on the multilayer dielectric substrate and configured with a plurality of polarized wave sharing antennas configured to radiate polarized waves in X and Y directions orthogonal to each other, in which the RFIC includes at least a switching unit configured to switch ON and OFF states of input or output of an RF signal and a variable phase shifter for each of the plurality of RF input/output terminals, two of the plurality of RF input/output terminals are connected to each of the plurality of polarized wave sharing antennas at feeding points corresponding to polarized waves orthogonal to each other, and the plurality of polarized wave sharing antennas includes a plurality of first polarized wave sharing antennas configured to radiate a polarized wave in the Y direction at a first operating frequency and configured to radiate a polarized wave in the X direction at a second operating frequency higher than the first operating frequency, and a plurality of second polarized wave sharing antennas configured to radiate a polarized wave in the X direction at a third operating frequency different from the first operating frequency and the second operating frequency and configured to radiate a polarized wave in the Y direction at the second operating frequency.

Still another disclosure provides a radio frequency module including a multilayer dielectric substrate, an RFIC connected to the multilayer dielectric substrate and having a plurality of RF input/output terminals, and an array antenna placed in or on the multilayer dielectric substrate and configured with a plurality of polarized wave sharing antennas configured to radiate polarized waves in X and Y directions orthogonal to each other, in which the RFIC includes at least a switching unit configured to switch ON and OFF states of input or output of an RF signal and a variable phase shifter for each of the plurality of RF input/output terminals, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a polarized wave in the X direction at a first operating frequency and configured to radiate a polarized wave in the Y direction at a second operating frequency higher than the first operating frequency, and a plurality of second polarized wave sharing antennas configured to radiate a polarized wave in the Y direction at the first operating frequency and configured to radiate a polarized wave in the X direction at the second operating frequency, the first polarized wave sharing antennas are arranged linearly such that each two of the first polarized wave sharing antennas adjacent to each other in one direction of the X and Y directions have an interval equal to or shorter than a free space wave length with respect to the second operating frequency, the second polarized wave sharing antennas are spaced apart from the plurality of first polarized wave sharing antennas arranged linearly at a fixed interval in the other direction orthogonal to the one direction, and are arranged linearly such that each two of the second polarized wave sharing antennas adjacent to each other in the one direction have an interval equal to or shorter than the free space wave length with respect to the second operating frequency, and the first polarized wave sharing antennas and the second polarized wave sharing antennas are alternately arranged in the one direction.

According to the present disclosure, it is possible to operate as a phased array, radio waves of a plurality of frequencies may be radiated, and radio waves of polarized waves in at least two directions may be radiated at one frequency.

DETAILED DESCRIPTION OF THE DISCLOSURE

Hereinafter, as a radio frequency module according to an embodiment of the present disclosure, a case where the present disclosure is applied to a communication device for millimeter waves will be exemplified and described in detail with reference to the accompanying drawings. Note that in this embodiment, a polarized wave parallel to an X direction among three axial directions (X direction, Y direction, and Z direction) orthogonal to each other is referred to as a horizontally polarized wave, and a polarized wave parallel to a Y direction is referred to as a vertically polarized wave.

Figure 1:
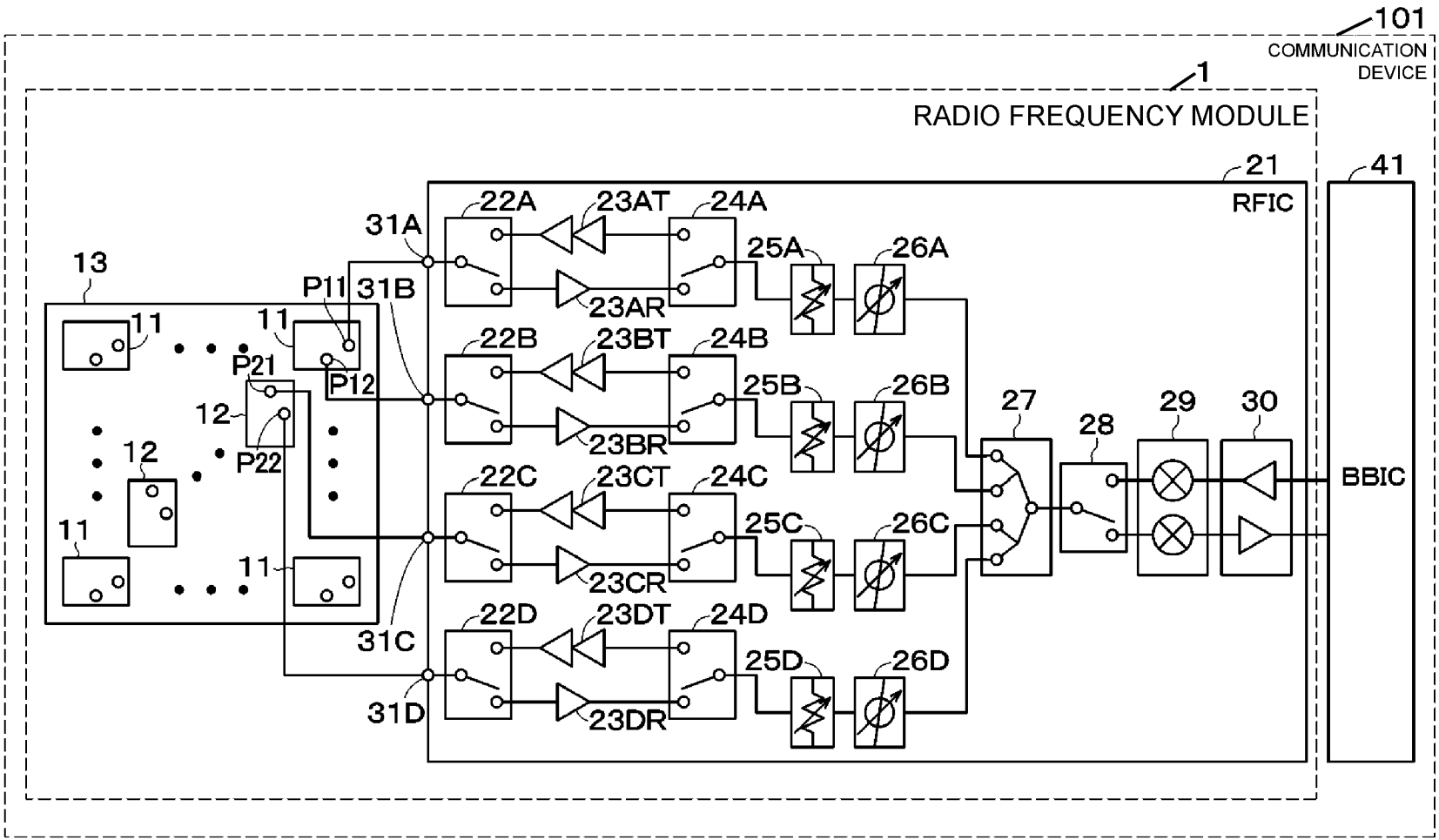
FIG. 1 is a block diagram illustrating a communication device according to a first embodiment of the present disclosure.

FIG. 1 is a block diagram illustrating an example of a communication device 101 to which a radio frequency module 1 according to the present embodiment is applied. The communication device 101 is, for example, a mobile terminal such as a cellular phone, a smartphone, a tablet, or the like, a personal computer having a communication function, or the like.

The communication device 101 includes the radio frequency module 1 and a baseband IC 41 (hereinafter, referred to as the BBIC 41) that configures a baseband signal processing circuit. The radio frequency module 1 includes an array antenna 13 and an RFIC 21 which is an example of a feeding circuit. The communication device 101 up-converts a signal transferred from the BBIC 41 to the radio frequency module 1 to a radio frequency signal, and radiates the signal from the array antenna 13, and downloads a radio frequency signal received by the array antenna 13 to process the downconverted signal in the BBIC 41.

Note that in FIG. 1, for ease of explanation, among a plurality of first patch antennas 11 and a plurality of second patch antennas 12 configuring the array antenna 13, only a configuration corresponding to a first feeding point P11 and a second feeding point P12 of one first patch antenna 11 and a first feeding point P21 and a second feeding point P22 of one second patch antenna 12 is illustrated, and configurations corresponding to the other first patch antennas 11 and second patch antennas 12 are omitted.

The RFIC 21 (radio frequency integrated circuit) includes switches 22A to 22D, 24A to 24D, and 28, power amplifiers 23AT to 23DT, low noise amplifiers 23AR to 23DR, attenuators 25A to 25D, variable phase shifters 26A to 26D, a signal multiplexer/demultiplexer 27, a mixer 29, and an amplifier circuit 30. The RFIC 21 is connected to the BBIC 41.

The RFIC 21 includes a plurality of RF input/output terminals 31A to 31D. The switches 22A to 22D are respectively connected to the first feeding point P11 and the second feeding point P12 of the first patch antenna 11 and the first feeding point P21 and the second feeding point P22 of the second patch antenna 12 with the RF input/output terminals 31A to 31D interposed therebetween.

When radio frequency signals RF11, RF12, RF21, and RF22 are transmitted, the switches 22A to 22D and 24A to 24D are respectively switched to the sides of the power amplifiers 23AT to 23DT, and the switch 28 is connected to an amplifier on a transmission side of the amplifier circuit 30. When radio frequency signals RF11, RF12, RF21, and RF22 are received, the switches 22A to 22D and 24A to 24D are respectively switched to the sides of the low noise amplifiers 23AR to 23DR, and the switch 28 is connected to an amplifier on a reception side of the amplifier circuit 30.

A signal transferred from the BBIC 41 is amplified by the amplifier circuit 30, and is up-converted by the mixer 29. Transmission signals which are the up-converted radio frequency signals RF11, RF12, RF21, and RF22 are generated by being demultiplexed by the signal multiplexer/demultiplexer 27, pass through four signal paths, and are respectively fed to the first feeding point P11 and the second feeding point P12 of the first patch antenna 11 and the first feeding point P21 and the second feeding point P22 of the second patch antenna 12. At this time, the variable phase shifters 26A to 26D disposed in the respective signal paths individually adjust phases of the radio frequency signals RF11, RF12, RF21, and RF22, so that directivity of the array antenna 13 may be adjusted.

Reception signals which are radio frequency signals RF11, RF12, RF21 and RF22 received by the first patch antenna 11 and the second patch antenna 12 are multiplexed by the signal multiplexer/demultiplexer 27 via four different signal paths. The multiplexed reception signal is down-converted by the mixer 29, is amplified by the amplifier circuit 30, and is transferred to the BBIC 41.

The RFIC 21 is formed as, for example, a one-chip integrated circuit component including the circuit configuration described above. Alternatively, devices (switches, power amplifiers, low noise amplifiers, attenuators, variable phase shifters) corresponding to the respective feeding points P11, P12, P21, and P22 in the RFIC 21 may be formed as one-chip integrated circuit component for each of the corresponding feeding points P11, P12, P21, and P22.

The switching unit for switching ON and OFF states of input or output of the radio frequency signals RF11, RF12, RF21 and RF22 is not limited to the switches 22A to 22D, 24A to 24D, and 28. The switching unit may be, for example, the power amplifiers 23AT to 23DT or low noise amplifiers 23AR to 23DR. That is, by adjusting gains of the power amplifiers 23AT to 23DT or the low noise amplifiers 23 AR to 23 DR, the ON and OFF states of the input or output of the radio frequency signals RF11, RF12, RF21, and RF22 may be switched. The power amplifiers 23AT to 23DT and the low noise amplifiers 23AR to 23DR may be switched between driving and stopping. The switching unit may be provided separately from the switches 22A to 22D, 24A to 24D, and 28 for switching between transmission and reception, and may be switches capable of switching the ON and OFF states for the respective paths. Further, the variable phase shifters 26A to 26D may be either digital phase shifters or analog phase shifters.

Next, the radio frequency module 1 according to the first embodiment will be described. FIG. 2 to FIG. 7 illustrate the radio frequency module 1 according to the first embodiment of the present disclosure. The radio frequency module 1 includes a multilayer dielectric substrate 2 to be described later, the array antenna 13, the RFIC 21, and the like.

Figure 5:
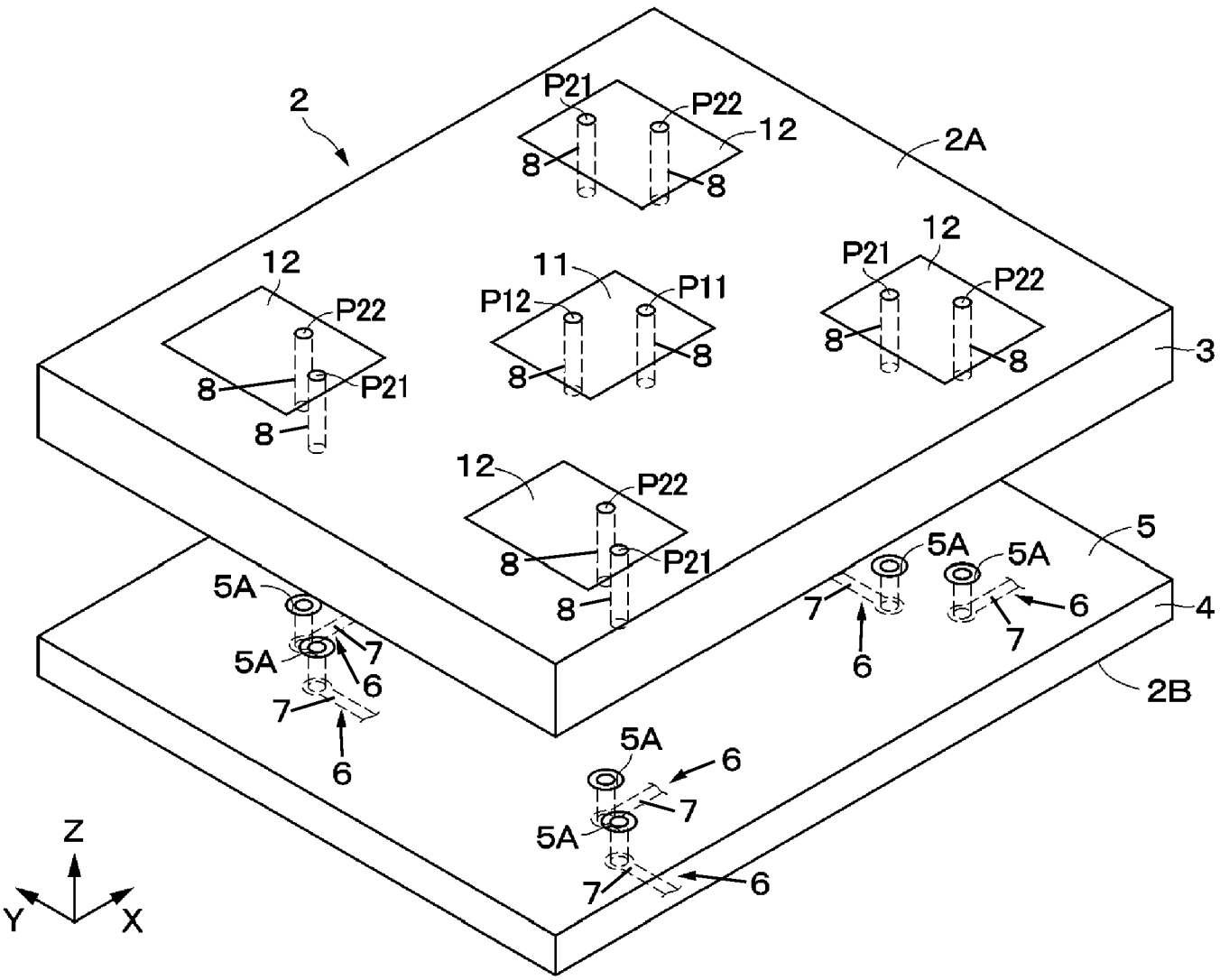
FIG. 5 is an exploded perspective view illustrating one first patch antenna and four second patch antennas taken out from and illustrated in a part B in FIG. 2.
Figure 6:
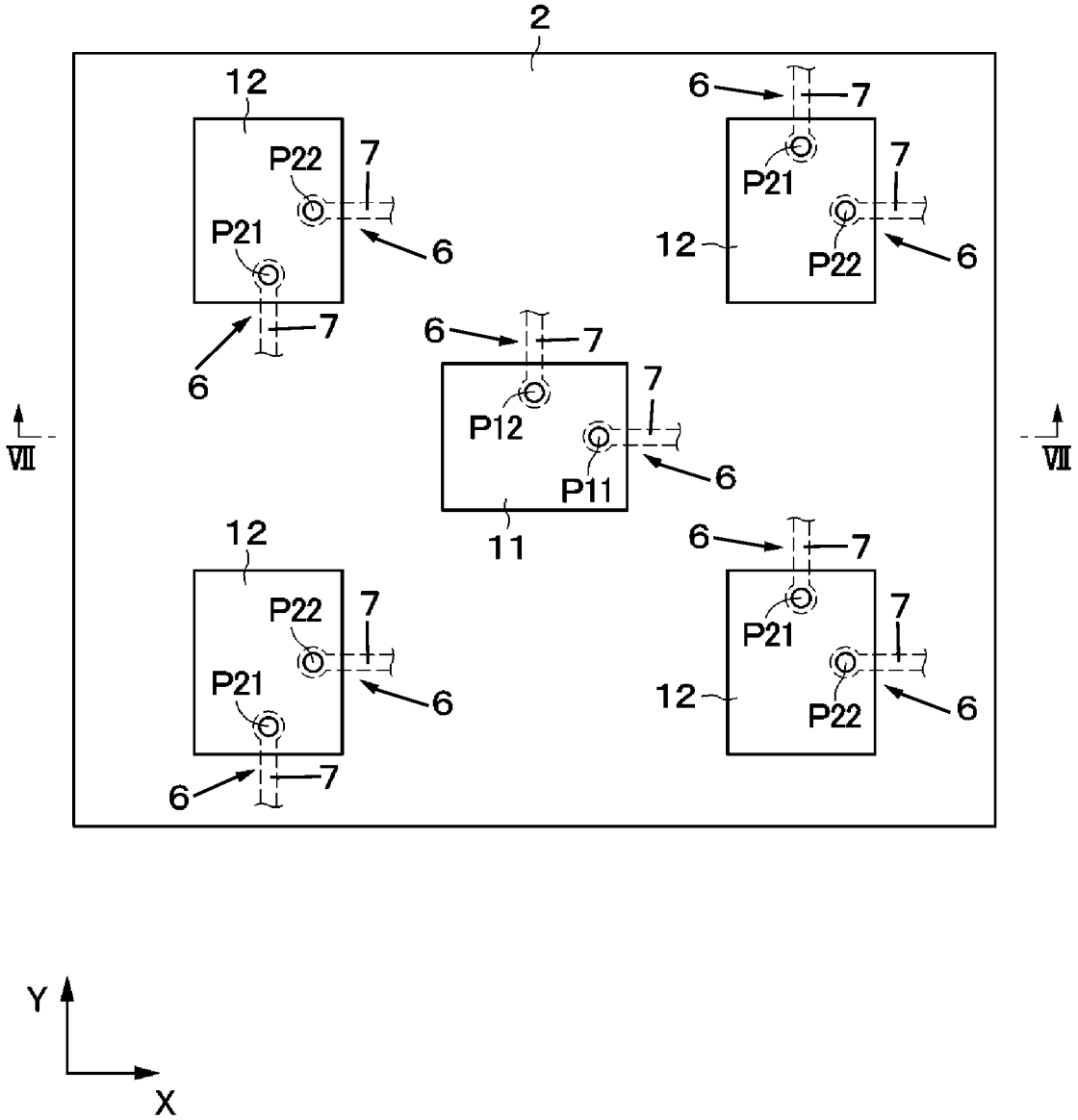
FIG. 6 is a plan view illustrating the first patch antenna and the second patch antennas in FIG. 5.
Figure 7:
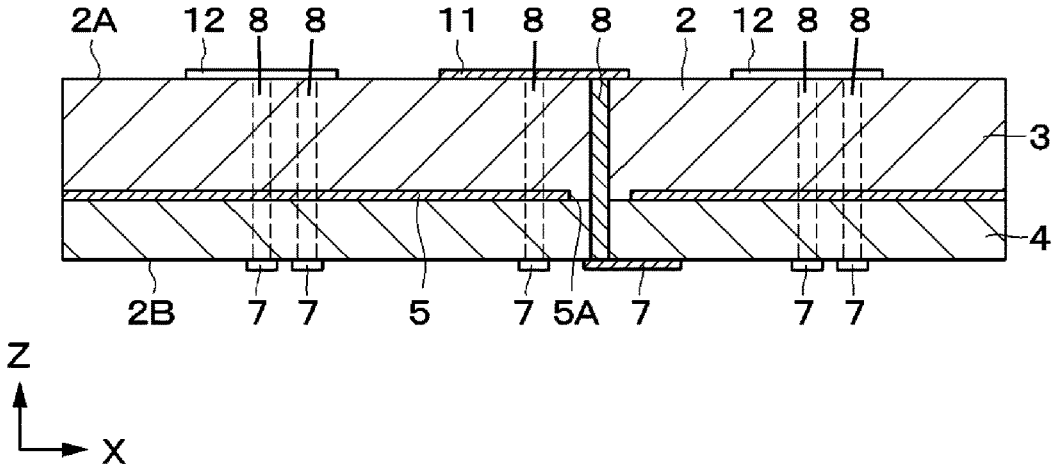
FIG. 7 is a cross-sectional view of the first patch antenna and the second patch antennas viewed from a direction of arrows VII-VII in FIG. 6.

As illustrated in FIG. 5 to FIG. 7, the multilayer dielectric substrate 2 is formed in a flat plate shape extending parallel to, for example, the X direction and the Y direction, among the X direction (length direction), the Y direction (width direction) and the Z direction (thickness direction) orthogonal to each other.

In addition, the multilayer dielectric substrate 2 is made of, for example, a ceramic material or a resin material as a material having insulation properties. The multilayer dielectric substrate 2 includes two insulating layers 3 and 4 laminated in the Z direction from an upper surface 2A side (front surface side) toward a lower surface 2B side (rear surface side). Each of the insulating layers 3 and 4 is formed in a thin layer shape.

A ground layer 5 is provided between the insulating layer 3 and the insulating layer 4, and covers the multilayer dielectric substrate 2 substantially over the entire surface (see FIG. 5 and FIG. 7). The ground layer 5 is formed using a conductive metal material such as copper, silver, or the like, and is connected to the ground. Specifically, the ground layer 5 is formed of a metal thin film.

Feeder lines 6 are configured by using, for example, a microstrip line (see FIG. 5 and FIG. 6). The feeder lines 6 are provided on a side opposite to the patch antennas 11 and 12 as viewed from the ground layer 5, and feed power to the patch antennas 11 and 12. Specifically, the feeder lines 6 are configured with the ground layer 5 and strip conductors 7 provided on the side opposite to the patch antenna 11 and 12 as viewed from the ground layer 5. Each of the strip conductors 7 is made of, for example, a conductive metal material similar to that of the ground layer 5, is formed in an elongated strip shape, and is provided on the lower surface 2B (lower surface of the insulating layer 4) of the multilayer dielectric substrate 2.

Also, end portions of some strip conductors 7 are disposed at center portions of connection openings 5A formed in the ground layer 5, and are connected to intermediate positions in the X direction or the Y direction of the first patch antennas 11 with vias 8 interposed therebetween as connection lines (see FIG. 6). Thus, the feeder lines 6 transfer radio frequency signals RF1 and RF2 and feed power to the first patch antenna 11 such that currents I11 and I12 flow in the X direction or the Y direction of the first patch antenna 11 (see FIG. 4).

Additionally, end portions of remaining strip conductors 7 are disposed at the center portions of the connection openings 5A formed in the ground layer 5, and are connected to intermediate positions in the Y direction or the X direction of the second patch antennas 12 with the vias 8 interposed therebetween as connection lines (see FIG. 6). Thus, the feeder lines 6 transfer radio frequency signals RF1 and RF2 and feed power to the second patch antenna 12 such that currents I21 and I22 flow in the Y direction or the X direction of the second patch antenna 12 (see FIG. 4).

As illustrated in FIG. 5 to FIG. 7, the via 8 is formed as a columnar conductor by providing, for example, a conductive metal material such as copper, silver, or the like in a through-hole having an inner diameter of about several tens to several hundreds of μm and penetrating through the multilayer dielectric substrate 2 (insulating layers 3 and 4). Further, the via 8 extends in the Z direction. One end of the via 8 is connected to the first patch antenna 11 or the second patch antenna 12. The other end of the via 8 is connected to the strip conductor 7.

Thus, the via 8 configures a connection line between the patch antenna 11 or 12 and the feeder line 6. The via 8 is connected to the first feeding point P11 at a position that is between a center position and an end position in the X direction and that is at a substantially center position in the Y direction, of the first patch antenna 11. Additionally, the via 8 is connected to the second feeding point P12 at a position that is between a center position and an end position in the Y direction and that is at a substantially center position in the X direction (see FIG. 5).

On the other hand, the via 8 is connected to the first feeding point P21 at a position that is between a center position and an end position in the Y direction and that is at a substantially center position in the X direction, of the second patch antenna 12. In addition, the via 8 is connected to the second feeding point P22 at a position that is between a center position and an end position in the X direction and that is at a substantially center position in the Y direction (see FIG. 5).

The first patch antenna 11 is formed of a conductor thin film pattern having a substantially rectangular shape. The first patch antenna 11 is formed using, for example, a conductive metal material similar to that of the ground layer 5.

The first patch antenna 11 faces the ground layer 5 with an interval therebetween (see FIG. 7). Specifically, the first patch antenna 11 is disposed on an upper surface of the insulating layer 3 (the upper surface 2A of the multilayer dielectric substrate 2). That is, the first patch antenna 11 is laminated on the upper surface of the ground layer 5 with the insulating layer 3 interposed therebetween. Therefore, the first patch antenna 11 faces the ground layer 5 in a state where the first patch antenna 11 is insulated from the ground layer 5.

Figure 4:
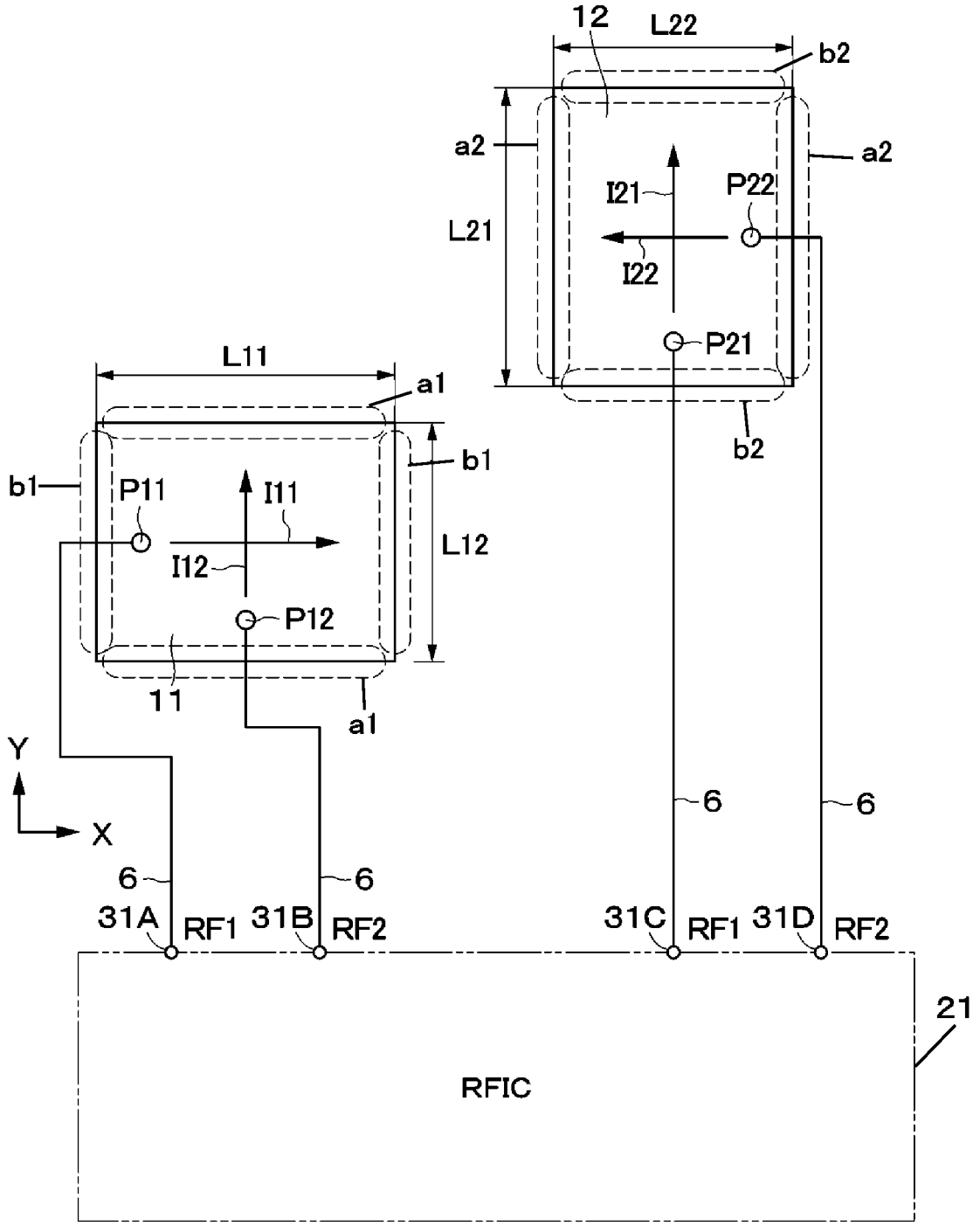
FIG. 4 is a configuration diagram illustrating a first patch antenna and a second patch antenna taken out from and illustrated in a part A in FIG. 2.

As illustrated in FIG. 4, the first patch antenna 11 has a length dimension L11 of about several hundreds of μm to several mm, for example, in the X direction and a length dimension L12 of about several hundreds of μm to several mm, for example, in the Y direction. The length dimension L11 in the X direction of the first patch antenna 11 is set to a value which is, for example, a half wave length of the first radio frequency signal RF1 in terms of electrical length. On the other hand, the length dimension L12 in the Y direction of the first patch antenna 11 is set to a value which is, for example, a half wave length of the second radio frequency signal RF2 in terms of electrical length.

In this case, the second operating frequency of the second radio frequency signal RF2 is higher than the first operating frequency of the first radio frequency signal RF1. That is, a center frequency F2 of the second operating frequency is higher than a center frequency F1 of the first operating frequency (F2>F1). Therefore, the first patch antenna 11 is formed in a rectangular shape in which the length dimension L12 in the Y direction is shorter than the length dimension L11 in the X direction.

Thus, the first patch antenna 11 radiates a polarized wave in the X direction at the first operating frequency having a predetermined operating band B1. In addition, the first patch antenna 11 radiates a polarized wave in the Y direction at the second operating frequency having a predetermined operating band B2.

Figure 8:
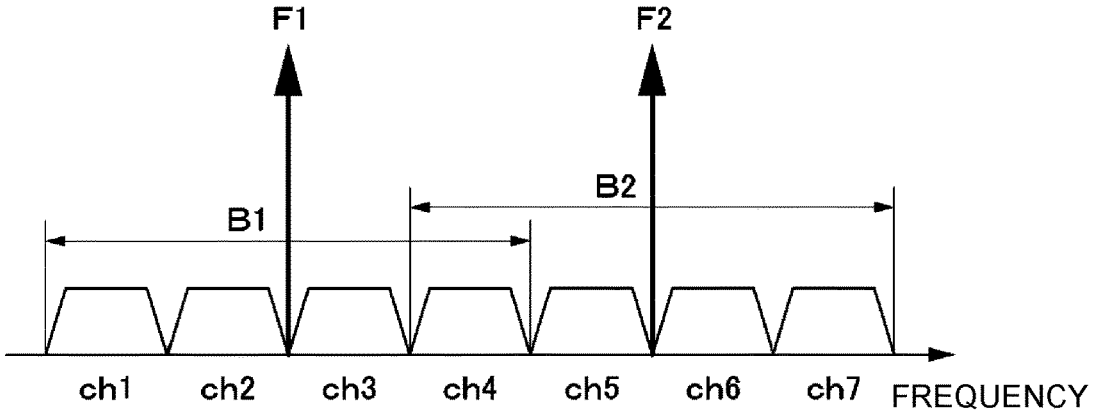
FIG. 8 is an explanatory diagram illustrating a relationship between an operating band of a first operating frequency and an operating band of a second operating frequency.

As illustrated in FIG. 8, the operating band B1 of the first operating frequency and the operating band B2 of the second operating frequency overlap each other on a frequency axis. Specifically, for example, when a 60 GHz band is divided into seven channels Ch1 to Ch7 to perform communication, the operating band B1 of the first operating frequency corresponds to the four channels Ch1 to Ch4 on a low frequency side of the seven channels Ch1 to Ch7. On the other hand, the operating band B2 of the second operating frequency corresponds to the four channels Ch4 to Ch7 on a high frequency side of the seven channels Ch1 to Ch7.

That is, the operating band B1 of the first operating frequency corresponds to a band satisfying the standard of IEEE 802.11ad, for example. Therefore, the operating band B1 of the first operating frequency covers the four channels Ch1 to Ch4 (radio channels) having center frequencies of 58.32 GHz, 60.48 GHz, 62.64 GHz, and 64.8 GHz, respectively. In this case, a bandwidth of each of the channels Ch1 to Ch4 is 2.16 GHz. On the other hand, in the standard of IEEE 802.11ay standard, a band (three channels) is extended to the high frequency side with respect to the standard of IEEE 802.11ad. That is, in the IEEE 802.11ay standard, seven channels Ch1 to Ch7 are provided, and four channels Ch1 to Ch4 on the low frequency side among the seven channels correspond to the IEEE 802.11ad standard. Therefore, the operating band B2 of the second operating frequency covers the four channels Ch4 to Ch7 on the high frequency side among the seven channels based on the standard of IEEE 802.11ay, for example. Therefore, the operating band B1 of the first operating frequency and the operating band B2 of the second operating frequency overlap each other on the channel Ch4 having the center frequency of 64.8 GHz. Then, as illustrated by the following expression of Math. 1, the highest frequency in the operating band B1 of the first operating frequency is higher than the lowest frequency in the operating band B2 of the second operating frequency.

$$F1 + \frac{B1}{2} > F2 - \frac{B2}{2} \quad \text{[Math. 1]}$$

As illustrated in FIG. 4, the first patch antenna 11 has the first feeding point P11 to which the via 8 is connected at an intermediate position in the X direction which is shifted from the center. For this reason, the feeder line 6 is connected to the first feeding point P11 of the first patch antenna 11 with the via 8 interposed therebetween. That is, the end portion of the strip conductor 7 is connected to the first patch antenna 11 with the via 8 interposed therebetween as the connection line. Moreover, the current I11 flows in the X direction in the first patch antenna 11 by feeding power from the feeder line 6 to the first feeding point P11.

On the other hand, the first patch antenna 11 has the second feeding point P12 to which the via 8 is connected at an intermediate position in the Y direction which is shifted from the center. For this reason, the feeder line 6 is connected to the second feeding point P12 of the first patch antenna 11 with the via 8 interposed therebetween. That is, the end portion of the strip conductor 7 is connected to the first patch antenna 11 with the via 8 interposed therebetween as the connection line. Moreover, the current I12 flows in the Y direction in the first patch antenna 11 by feeding power from the feeder line 6 to the second feeding point P12.

As a result, the first patch antenna 11 may radiate a polarized wave in the X direction (horizontally polarized wave) and a polarized wave in the Y direction (vertically polarized wave) as two polarized waves orthogonal to each other. The first patch antenna 11 configures a first polarized wave sharing antenna capable of radiating two polarized waves (horizontally polarized wave and vertically polarized wave).

Note that the first feeding point P11 may be shifted from the center of the first patch antenna 11 to one side in the X direction, or may be shifted to the other side in the X direction. Similarly, the second feeding point P12 may be shifted from the center of the first patch antenna 11 to one side in the Y direction, or may be shifted to the other side in the Y direction.

The second patch antenna 12 is formed substantially in the similar manner to the first patch antenna 11. Therefore, the second patch antenna 12 is formed by a conductor thin film pattern having a substantially rectangular shape. The second patch antenna 12 faces the ground layer 5 with an interval therebetween. More specifically, the second patch antenna 12 is disposed on the upper surface (upper surface 2A of the multilayer dielectric substrate 2) of the insulating layer 3, similarly to the first patch antenna 11.

As illustrated in FIG. 4, the second patch antenna 12 has a shape in which the first patch antenna 11 is rotated by 90 degrees on the same XY plane (on the upper surface 2A) as the first patch antenna 11. For this reason, the second patch antenna 12 has a length dimension L21 of about several hundreds of μm to several mm, for example, in the Y direction and a length dimension L22 of about several hundreds of μm to several mm, for example, in the X direction.

The length dimension L21 in the Y direction of the second patch antenna 12 is set to a value which is, for example, a half wave length of the first radio frequency signal RF1 (center frequency F1) in terms of electrical length. On the other hand, the length dimension L22 in the X direction of the second patch antenna 12 is set to a value which is, for example, a half wave length of the second radio frequency signal RF2 (center frequency F2) in terms of electrical length.

In this case, the second radio frequency signal RF2 is a signal having a higher frequency than that of the first radio frequency signal RF1. Therefore, the second patch antenna 12 is formed in a rectangular shape in which the length dimension L22 in the X direction is shorter than the length dimension L21 in the Y direction.

Thus, the second patch antenna 12 radiates a polarized wave in the Y direction at the first operating frequency having the operating band B1. In addition, the second patch antenna 12 radiates a polarized wave in the X direction at the second operating frequency having the operating band B2.

Further, the second patch antenna 12 has the first feeding point P21 to which the via 8 is connected at an intermediate position in the Y direction which is shifted from the center. For this reason, the feeder line 6 is connected to the first feeding point P21 of the second patch antenna 12 with the via 8 interposed therebetween. In the second patch antenna 12, the current I21 flows in the Y direction by feeding power from the feeder line 6 to the first feeding point P21.

On the other hand, the second patch antenna 12 has the second feeding point P22 to which the via 8 is connected at an intermediate position in the X direction which is shifted from the center. For this reason, the feeder line 6 is connected to the second feeding point P22 of the second patch antenna 12 with the via 8 interposed therebetween. In the second patch antenna 12, the current I22 flows in the X direction by feeding power from the feeder line 6 to the second feeding point P22.

As a result, the second patch antenna 12 may radiate a polarized wave in the Y direction (vertically polarized wave) and a polarized wave in the X direction (horizontally polarized wave) as two polarized waves orthogonal to each other. The second patch antenna 12 configures the second polarized wave sharing antenna capable of radiating two polarized waves (vertically polarized wave and horizontally polarized wave).

Note that the first feeding point P21 may be shifted from the center of the second patch antenna 12 to one side in the Y direction, or may be shifted to the other side in the Y direction. Similarly, the second feeding point P22 may be shifted from the center of the second patch antenna 12 to one side in the X direction, or may be shifted to the other side in the X direction.

Figure 2:
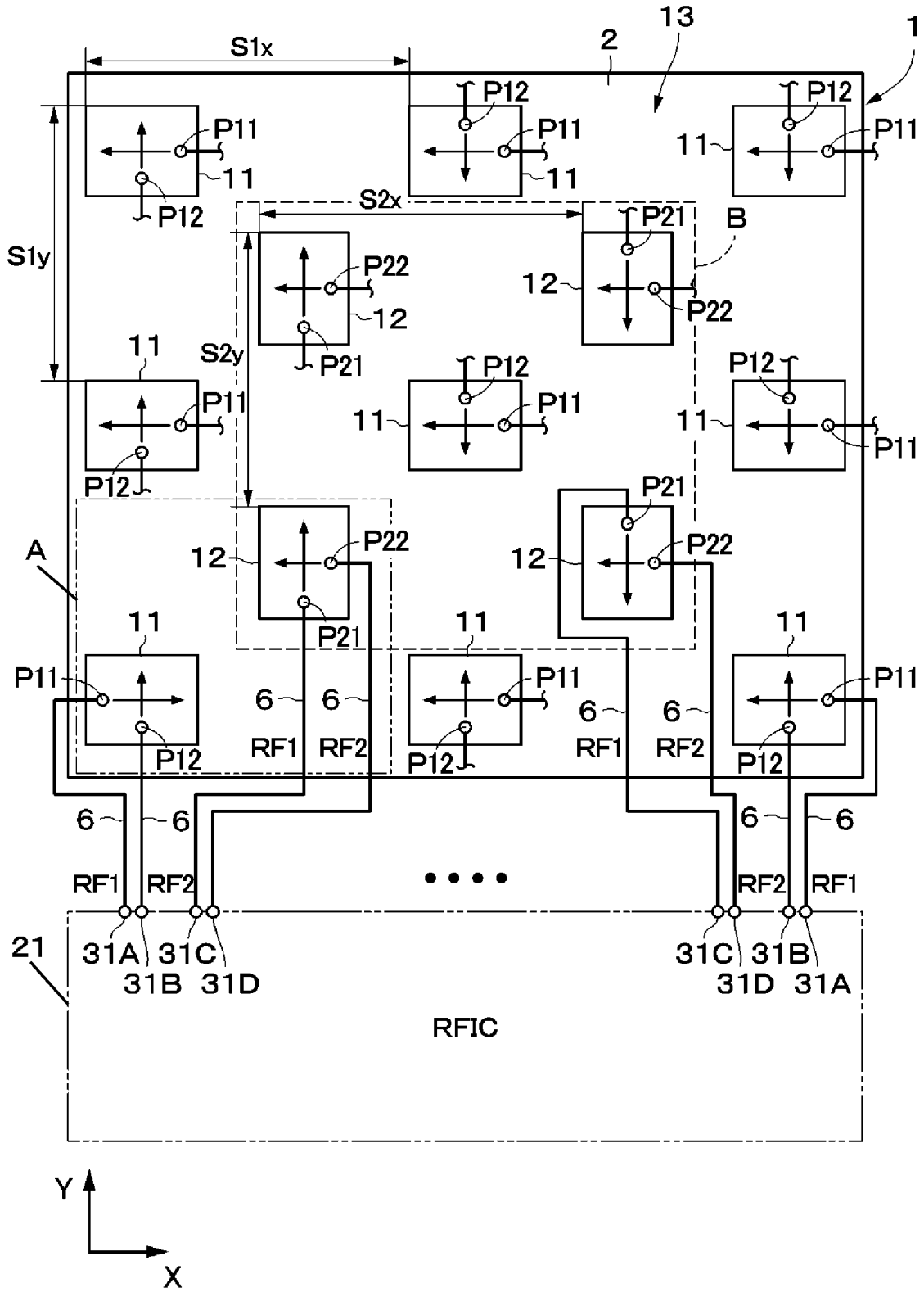
FIG. 2 is an overall configuration diagram illustrating a radio frequency module according to the first embodiment of the present disclosure.
Figure 3:
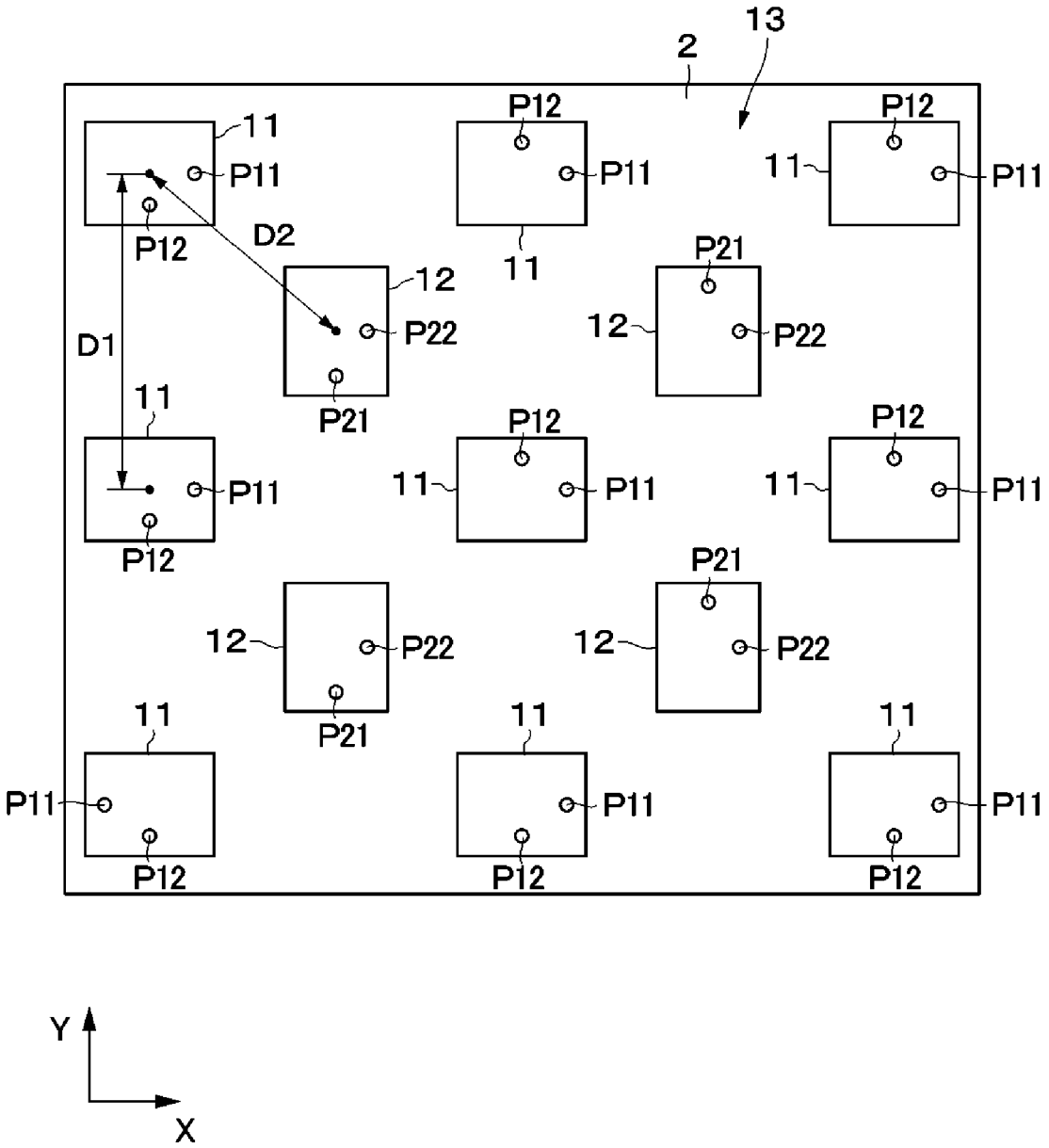
FIG. 3 is a plan view illustrating an array antenna in FIG. 2.

As illustrated in FIG. 2 and FIG. 3, nine first patch antennas 11 and four second patch antennas 12 configure the array antenna 13. Then, the nine first patch antennas 11 are arranged in a matrix shape with, for example, three rows and three columns on the upper surface 2A of the multilayer dielectric substrate 2. On the other hand, the four second patch antennas 12 are arranged in a matrix shape with, for example, two rows and two columns on the upper surface 2A of the multilayer dielectric substrate 2.

For example, nine first patch antennas 11 are arranged and placed in or on the upper surface 2A (see FIG. 7) of the multilayer dielectric substrate 2, namely, on the surface of the insulating layer 3 (see FIG. 2). The nine first patch antennas 11 are arranged at equal intervals in the X direction, and are arranged in three rows in the Y direction. In this case, the first patch antennas 11 are arranged in a matrix shape such that each two first patch antennas 11 adjacent to each other in the X direction and the Y direction have intervals S1$x$ and S1$y$ which are equal to or shorter than a free space wave length λ0 with respect to the second operating frequency. Then, the free space wave length λ0 corresponds to the highest frequency (for example, 72.36 GHz) in the operating band B2 of the second operating frequency.

The interval S1$x$ is, for example, a distance dimension in the X direction between centers of two first patch antennas 11 adjacent to each other or a dimension equivalent to the distance dimension in the X-direction. The interval S1$y$ is a distance dimension in the Y direction between the centers of two first patch antennas 11 adjacent to each other or a dimension equivalent to the distance dimension in the Y direction. The interval S1$x$ in the X direction and the interval S1$y$ in the Y direction may be the same value or different values. The interval S1$x$ is set to a value larger than an addition value (L11+L22) of the length dimension L11 in the X direction of the first patch antenna 11 and the length dimension L22 in the X direction of the second patch antenna 12. For this reason, the interval S1$x$ is set to a value satisfying a relationship of the expression of Math. 2.

$$L11+L22<S1x<\lambda 0 \quad \text{[Math. 2]}$$

Similarly, the interval S1$y$ is set to a value larger than an addition value (L12+L21) of the length dimension L12 in the Y direction of the first patch antenna 11 and the length dimension L21 in the Y direction of the second patch antenna 12. For this reason, the interval S1$y$ is set to a value satisfying a relationship of the expression of Math. 3.

$$L12+L21<S1y<\lambda 0 \quad \text{[Math. 3]}$$

Further, for example, four second patch antennas 12 are arranged and placed in or on the upper surface 2A (see FIG. 7) of the multilayer dielectric substrate 2, namely, on the surface of the insulating layer 3 (see FIG. 2). The four second patch antennas 12 are arranged at equal intervals in the X direction, and are arranged in two rows in the Y direction. In this case, the second patch antennas 12 are arranged in a matrix shape such that two second patch antennas 12 adjacent to each other in the X direction and the Y direction have intervals S2$x$ and S2$y$ which are equal to or shorter than the free space wave length λ0 with respect to the second operating frequency. Then, the interval S2$x$ in the X direction and the interval S2$y$ in the Y direction may be the same value or different values. The interval S2$x$ is, for example, a distance dimension in the X direction between centers of two second patch antennas 12 adjacent to each other or a dimension equivalent to the distance dimension in the X-direction. The interval S2$y$ is a distance dimension in the Y direction between the centers of two second patch antennas 12 adjacent to each other or a dimension equivalent to the distance dimension in the Y direction.

Note that the interval S2$x$ and the interval S1$x$ are set to the same value. Similarly, the interval S2$y$ and the interval S1$y$ are set to the same value. Therefore, the patch antennas 11 and 12 are arranged at equal intervals in the X direction and are arranged at equal intervals in the Y direction.

The three columns of the first patch antennas 11 and the two columns of the second patch antennas 12 are alternately arranged with respect to the X direction. The three rows of the first patch antennas 11 and the two rows of the second patch antennas 12 are alternately arranged with respect to the Y direction.

As a result, the nine first patch antennas 11 and the four second patch antennas 12 are arranged on the upper surface 2A of the multilayer dielectric substrate 2 in a staggered manner (at alternate positions). In this case, any one of the first patch antennas 11 (for example, the first patch antenna 11 arranged at the center in FIG. 2) is surrounded by four second patch antennas 12 and is arranged at the center position of these four second patch antennas 12. Similarly, any one of the second patch antennas 12 is surrounded by four first patch antennas 11, and is arranged at the center position of these four first patch antennas 11. Then, when a distance between any one of the first patch antennas 11 and another one of the first patch antennas 11 closest to the any one first patch antenna 11 is defined as D1, and a distance between any one of the first patch antennas 11 and the second patch antenna 12 closest to the any one first patch antenna 11 is defined as D2, D1>D2 is satisfied (see FIG. 3). The distance D1 is an interval dimension between centers of the two first patch antennas 11. The distance D2 is an interval dimension between centers of the first patch antenna 11 and the second patch antenna 12.

The RFIC 21 includes a plurality of RF input/output terminals 31A to 31D connected to the multilayer dielectric substrate 2. As illustrated in FIG. 2 and FIG. 4, the RFIC 21 includes at least the switches 22A to 22D, 24A to 24D, and 28 as the switching unit for switching ON and OFF states of input or output of RF signals (RF signals RF1 and RF2), and the variable phase shifters 26A to 26D, for the RF input/output terminals 31A to 31D, respectively (see FIG. 1).

In this case, the switches 22A to 22D, 24A to 24D, and 28 have a function for selecting the patch antennas 11 and 12, and the feeding points P11, P12, P21, and P22 for transmitting and receiving signals (a function for switching for each antenna). Radio frequency signals are supplied only to the patch antennas and the feeding points selected by the switches 22A to 22D, 24A to 24D, and 28. Radio frequency signals are supplied only from the patch antennas and the feeding points selected by the switches 22A to 22D, 24A to 24D, and 28.

Radio frequency signals RF1 and RF2 are respectively supplied to the first feeding point P11 and the second feeding point P12 of the first patch antenna 11 from the RFIC 21. Thus, the first patch antenna 11 radiates the radio frequency signal RF1 that is a horizontally polarized wave and radiates the radio frequency signal RF2 that is a vertically polarized wave (see FIG. 4).

Radio waves of the radio frequency signals RF1 and RF2 received by the first patch antenna 11 are supplied to the RFIC 21. The variable phase shifters 26A and 26B may independently control phases of the radio frequency signals RF1 and RF2 for the first feeding point P11 and the second feeding point P12, respectively.

Similarly, radio frequency signals RF1 and RF2 are respectively supplied from the RFIC 21 to the first feeding point P21 and the second feeding point P22 of the second patch antenna 12. Thereby, the second patch antenna 12 radiates the radio frequency signal RF1 that is a vertically polarized wave and radiates the radio frequency signal RF2 that is a horizontally polarized wave (see FIG. 4).

Radio waves of the radio frequency signals RF1 and RF2 received by the second patch antenna 12 are supplied to the RFIC 21. The variable phase shifters 26C and 26D may independently control phases of the radio frequency signals RF1 and RF2 for the first feeding point P21 and the second feeding point P22, respectively.

The RFIC 21 is attached, for example, on the lower surface 2B (see FIG. 7) of the multilayer dielectric substrate 2. The RF input/output terminals 31A to 31D of the RFIC 21 are electrically connected to the feeder lines 6 (see FIG. 4). As a result, the RFIC 21 is electrically connected to the first patch antenna 11 and the second patch antenna 12 with the feeder lines 6 and the vias 8 interposed therebetween. Note that the RFIC 21 may be attached on the upper surface 2A of the multilayer dielectric substrate 2. Further, when the RF input/output terminals 31A to 31D are electrically connected to the feeder lines 6, the RFIC 21 may be attached to a member separate from the multilayer dielectric substrate 2.

The radio frequency module 1 according to the present embodiment has the structure as described above, and an operation thereof will now be described.

When power is fed to the first feeding point P11 of the first patch antenna 11, the current I11 flows in the X direction in the first patch antenna 11. Thus, the first patch antenna 11 radiates a radio frequency signal RF1 that is a horizontally polarized wave upward from the upper surface 2A of the multilayer dielectric substrate 2, and the first patch antenna 11 receives a radio wave that is a radio frequency signal RF1.

At this time, when power is fed to the first feeding point P21 of the second patch antenna 12, the current I21 flows in the Y direction in the second patch antenna 12. Thus, the second patch antenna 12 radiates a radio frequency signal RF1 that is a vertically polarized wave upward from the upper surface 2A of the multilayer dielectric substrate 2, and the second patch antenna 12 receives a radio wave of a radio frequency signal RF1. Therefore, by using all the patch antennas 11 and 12, radio frequency signals RF1 being two kinds of polarized waves that are a vertically polarized wave and a horizontally polarized wave may be transmitted or received.

Similarly, when power is fed to the second feeding point P12 of the first patch antenna 11, the current I12 flows in the Y direction in the first patch antenna 11. Thus, the first patch antenna 11 radiates a radio frequency signal RF2 that is a vertically polarized wave upward from the upper surface 2A of the multilayer dielectric substrate 2, and the first patch antenna 11 receives a radio wave of a radio frequency signal RF2.

At this time, when power is fed to the second feeding point P22 of the second patch antenna 12, the current I22 flows in the X direction in the second patch antenna 12. Thus, the second patch antenna 12 radiates a radio frequency signal RF2 that is a horizontally polarized wave upward from the upper surface 2A of the multilayer dielectric substrate 2, and the second patch antenna 12 receives a radio wave of a radio frequency signal RF2. Therefore, by using all the patch antennas 11 and 12, radio frequency signals RF2 being two kinds of polarized waves that are a horizontally polarized wave and vertically polarized wave may be transmitted or received.

In addition, the radio frequency module 1 may scan a direction of a radiation beam of a horizontally polarized wave in the X direction and the Y direction by appropriately adjusting phases of radio frequency signals RF1 to be supplied to the plurality of first patch antennas 11. Further, the radio frequency module 1 may scan a direction of a radiation beam of a vertically polarized wave in the X direction and the Y direction by appropriately adjusting phases of radio frequency signals RF1 to be supplied to the plurality of second patch antennas 12.

Similarly, the radio frequency module 1 may scan a direction of a radiation beam of a vertically polarized wave in the X direction and the Y direction by appropriately adjusting phases of radio frequency signals RF2 to be supplied to the plurality of first patch antennas 11. Further, the radio frequency module 1 may scan a direction of a radiation beam of a horizontally polarized wave in the X direction and the Y direction by appropriately adjusting phases of radio frequency signals RF2 to be supplied to the plurality of second patch antennas 12.

Furthermore, one first patch antenna 11 is surrounded by four second patch antennas 12 arranged in a matrix shape, and is arranged at the center position of these four second patch antennas 12. In this case, when the first patch antenna 11 radiates a radio wave of a first radio frequency signal RF1, a wave source of the first patch antenna 11 is generated in edge portions (a1 portions in FIG. 4) located at both ends in the Y direction of the first patch antenna 11. On the other hand, when the second patch antenna 12 radiates a radio wave of a first radio frequency signal RF1, a wave source of the second patch antenna 12 is generated in edge portions (a2 portions in FIG. 4) located at both ends in the X direction of the second patch antenna 12.

Similarly, when the first patch antenna 11 radiates a radio wave of a second radio frequency signal RF2, a wave source of the first patch antenna 11 is generated in edge portions (b1 portions in FIG. 4) located at both ends in the X direction of the first patch antenna 11. On the other hand, when the second patch antenna 12 radiates a radio wave of a second radio frequency signal RF2, a wave source of the second patch antenna 12 is generated in edge portions (b2 portions in FIG. 4) located at both ends in the Y direction of the second patch antenna 12.

Here, as for the first radio frequency signal RF1, the wave source of the first patch antenna 11 and the wave source of the second patch antenna 12 are arranged orthogonal to each other. For this reason, coupling of the first radio frequency signals RF1 is suppressed between the first patch antenna 11 and the second patch antenna 12. Similarly, as for the second radio frequency signal RF2, the wave source of the first patch antenna 11 and the wave source of the second patch antenna 12 are arranged orthogonal to each other. For this reason, coupling of the second radio frequency signals RF2 is suppressed between the first patch antenna 11 and the second patch antenna 12.

In addition, the first patch antenna 11 is surrounded by four second patch antennas 12, and is arranged at the center position of the four second patch antennas 12. Therefore, interference from the first patch antenna 11 to the second patch antenna 12 occurs equally with respect to the four second patch antennas 12 located around the first patch antenna 11. Therefore, it is possible to cancel the interference from the first patch antenna 11 to the second patch antenna 12 by control of the phase shifters in the RFIC 21. As a result, good isolation may be achieved between the first patch antenna 11 and the second patch antenna 12.

Thus, according to the present embodiment, both the first patch antenna 11 and the second patch antenna 12 may radiate radio waves of two frequencies that are the first operating frequency (first radio frequency signal RF1) and the second operating frequency (second radio frequency signal RF2). Therefore, a frequency band (operating band) may be widened, compared to a case where a radio wave of only one frequency is radiated.

Further, the first patch antenna 11 radiates a polarized wave in the X direction (horizontally polarized wave) at the first operating frequency, and the second patch antenna 12 radiates a polarized wave in the Y direction (vertically polarized wave) at the first operating frequency. Therefore, by using the first patch antenna 11 and the second patch antenna 12, polarized waves in two directions that are the X direction and the Y direction may be radiated at the first operating frequency.

In addition, the first patch antenna 11 radiates a polarized wave in the Y direction (vertically polarized wave) at the second operating frequency, and the second patch antenna 12 radiates a polarized wave in the X direction (horizontally polarized wave) at the second operating frequency. Therefore, by using the first patch antenna 11 and the second patch antenna 12, polarized waves in two directions that are the X direction and the Y direction may be radiated at the second operating frequency. As a result, the first patch antenna 11 and the second patch antenna 12 may radiate radio waves of polarized waves in two directions at two frequencies.

Moreover, one first patch antenna 11 is surrounded by four second patch antennas 12 arranged in a matrix shape, and is arranged at the center position of the four second patch antennas 12. Therefore, the first patch antenna 11 is arranged so as to be shifted in the X direction and the Y direction with respect to the four second patch antennas 12 located around the first patch antenna 11. As a result, mutual coupling between the first patch antenna 11 and the second patch antenna 12 may be suppressed, and isolation may be enhanced.

The plurality of first patch antennas 11 and the plurality of second patch antennas 12 are connected to the RFIC 21 having the variable phase shifters 26A to 26D respectively corresponding to the plurality of RF input/output terminals 31A to 31D. Therefore, the plurality of first patch antennas 11 and the plurality of second patch antennas 12 may operate as a phased array.

Note that in the first embodiment, the operating band B1 of the first operating frequency and the operating band B2 of the second operating frequency overlap each other on only one channel on the frequency axis. The overlap is not limited to one channel among the four channels in the operating band B1 of the first operating frequency, but may be two channels or three channels. Further, the operating bands B1 and B2 are not limited to four channels, but may be five channels or six channels.

Figure 9:
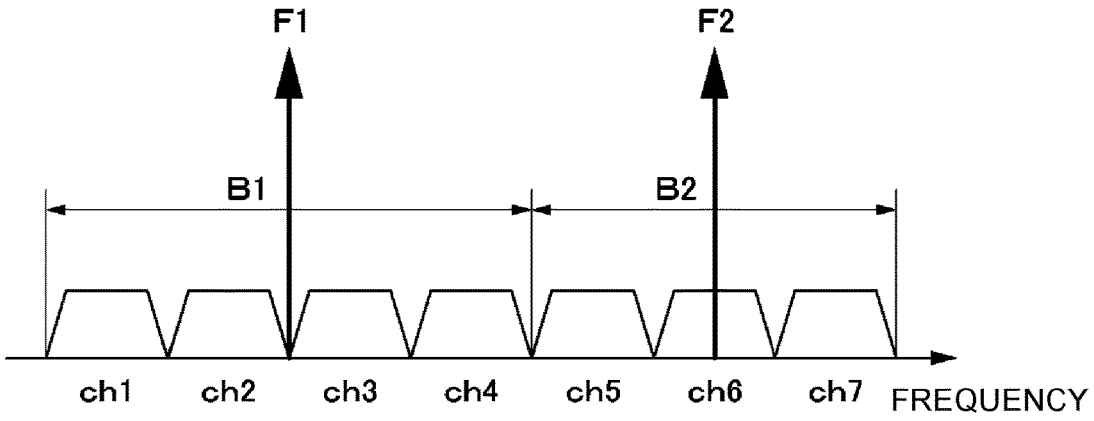
FIG. 9 is an explanatory diagram illustrating a relationship between an operating band of a first operating frequency and an operating band of a second operating frequency according to a first modification.

In the first embodiment, the operating band B1 of the first operating frequency and the operating band B2 of the second operating frequency overlap each other on the frequency axis. The present disclosure is not limited to this, and the operating band B1 of the first operating frequency and the operating band B2 of the second operating frequency may be adjacent to each other on the frequency axis as in a first modification illustrated in FIG. 9. The operating band B1 of the first operating frequency in FIG. 9 corresponds to four channels Ch1 to Ch4 on a low frequency side of seven channels Ch1 to Ch7 in the 60 GHz band, for example. On the other hand, the operating band B2 of the second operating frequency corresponds to three channels Ch5 to Ch7 on a high frequency side of the seven channels Ch1 to Ch7. In this case, a center frequency F2 of the second operating frequency coincides with a center frequency of the channel Ch6. When the operating band B1 of the first operating frequency and the operating band B2 of the second operating frequency are adjacent to each other on the frequency axis, it is possible to secure an operating band which is at most twice as large as that of a case where a single operating frequency is used.

Figure 10:
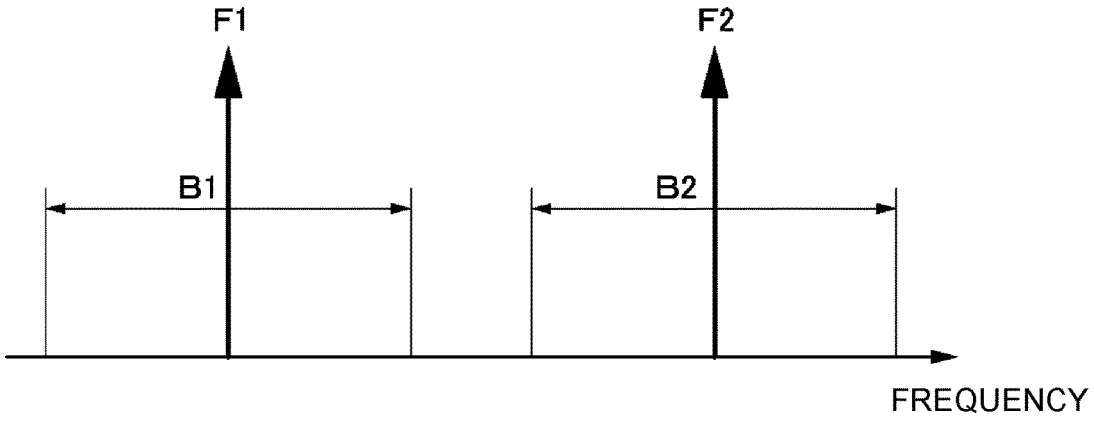
FIG. 10 is an explanatory diagram illustrating a relationship between an operating band of a first operating frequency and an operating band of a second operating frequency according to a second modification.

Also, as in a second modification illustrated in FIG. 10, the operating band B1 of the first operating frequency and the operating band B2 of the second operating frequency may be spaced apart from each other on the frequency axis. In this case, isolation between the operating bands B1 and B2 may be ensured.

Figure 11:
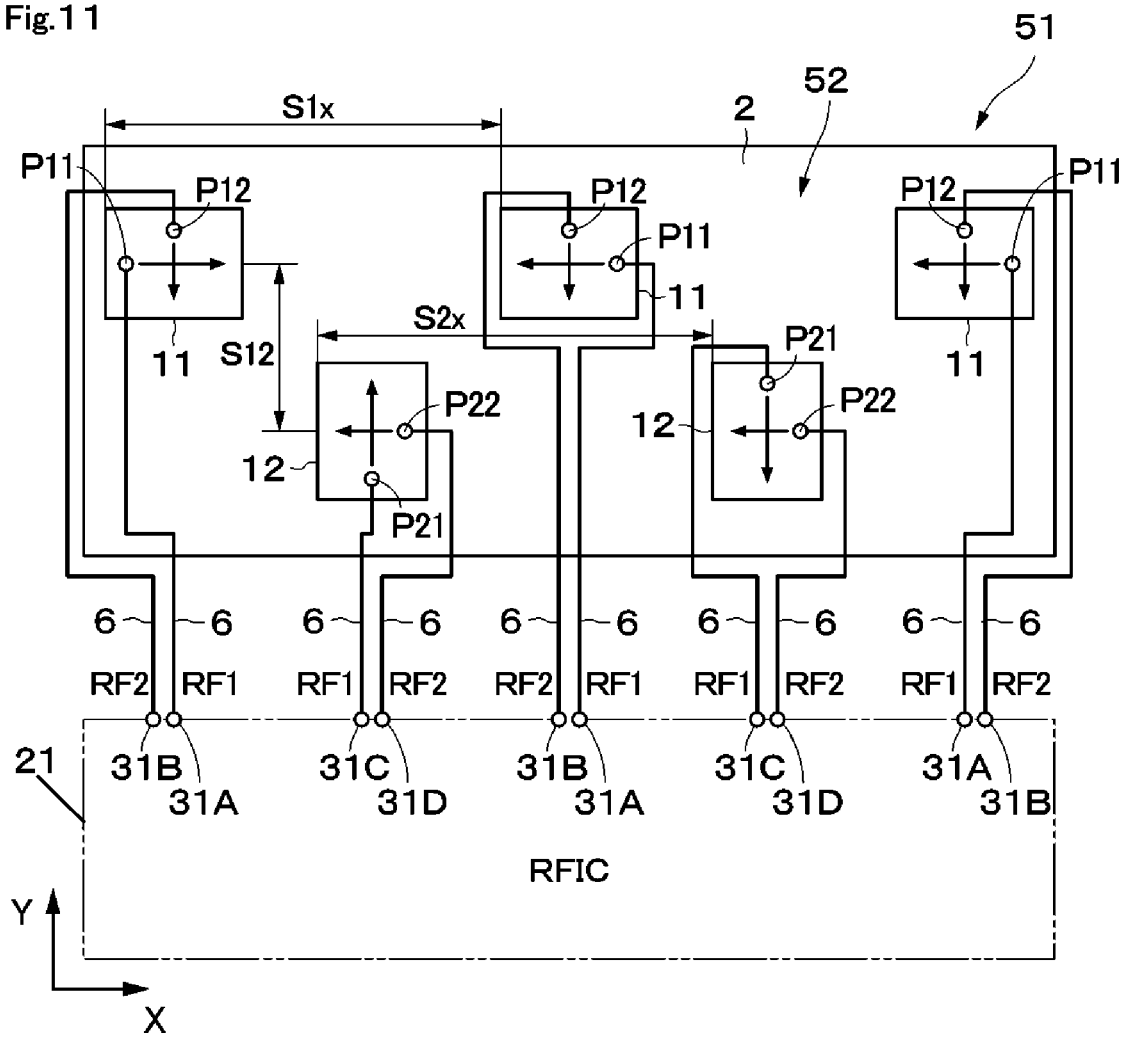
FIG. 11 is an overall configuration diagram illustrating a radio frequency module according to a second embodiment of the present disclosure.
Figure 12:
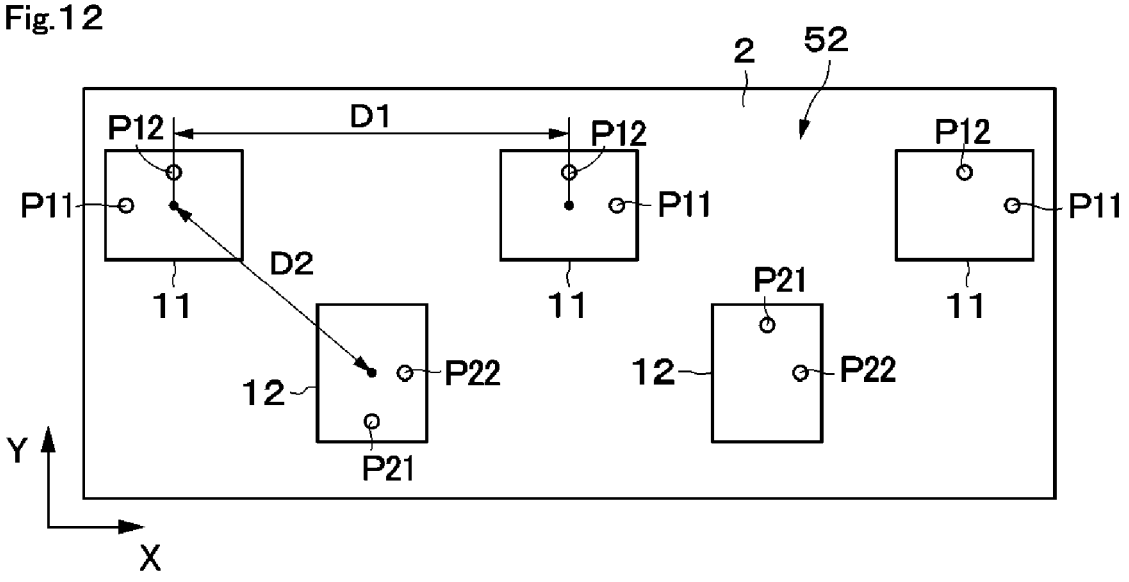
FIG. 12 is a plan view illustrating an array antenna in FIG. 11.

Next, FIG. 11 and FIG. 12 illustrate a second embodiment of the present disclosure. A feature of the second embodiment is in that a plurality of first patch antennas is arranged linearly in an X direction, a plurality of second patch antennas is also arranged linearly in the X direction, and the first patch antennas and the second patch antennas are spaced apart from each other in a Y direction at a fixed interval. In the second embodiment, the similar constituent elements as those in the first embodiment are denoted by the same reference signs, and the description thereof will not be repeated.

FIG. 11 illustrates a radio frequency module 51 according to the second embodiment of the present disclosure. The radio frequency module 51 includes the multilayer dielectric substrate 2 to be described later, an array antenna 52, the RFIC 21, and the like.

As for the first patch antennas 11, each two first patch antennas 11 adjacent to each other in the X direction are arranged linearly at the intervals S1$x$ equal to or shorter than the free space wave length $\lambda 0$ with respect to the second operating frequency. More specifically, three first patch antennas 11 are arranged linearly in the X direction.

On the other hand, as for the second patch antennas 12, two second patch antennas 12 adjacent to each other in the X direction are arranged linearly at the interval S2$x$ equal to or shorter than the free space wave length $\lambda 0$ with respect to the second operating frequency. More specifically, two second patch antennas 12 are arranged linearly in the X direction. Note that the interval S2$x$ and the interval S1$x$ are set to the same value. Therefore, the patch antennas 11 and 12 are arranged at equal intervals in the X direction. In addition, each of the second patch antennas 12 sandwiched between two first patch antennas 11 in the X direction is arranged at the center position between the two first patch antennas 11. Similarly, the first patch antenna 11 sandwiched between the two second patch antennas 12 in the X direction is arranged at the center position between the two second patch antennas 12.

In addition, the second patch antennas 12 are spaced apart from the plurality of first patch antennas 11 arranged linearly, at a fixed interval S12 in the Y direction. The fixed interval S12 is a distance dimension in the Y direction between the center of the first patch antenna 11 and the center of the second patch antenna 12, or a dimension equivalent to the distance dimension in the Y direction. The fixed interval S12 is, for example, a value equal to or shorter than the free space wavelength $\lambda 0$ with respect to the second operating frequency, and is set to a value larger than the length dimension L12 in the Y direction of the first patch antenna 11. The first patch antennas 11 and the second patch antennas 12 are alternately arranged in the X direction. When a distance between any one of the first patch antennas 11 and another one of the first patch antennas 11 closest to the any one first patch antenna 11 is defined as D1 and a distance between any one of the first patch antennas 11 and the second patch antenna 12 closest to the any one first patch antenna 11 is defined as D2, D1>D2 is satisfied (see FIG. 12).

As illustrated in FIG. 11 and FIG. 12, the three first patch antennas 11 and the two second patch antennas 12 configure the array antenna 52.

Thus, also in the second embodiment configured as described above, substantially similar operational effects as those of the first embodiment described above may be obtained. Further, the plurality of first patch antennas 11 is arranged linearly in the X direction. Further, the plurality of second patch antennas 12 is spaced apart from the plurality of first patch antennas 11 in the Y direction orthogonal to the X direction, and is arranged linearly in the X direction. In addition, the first patch antennas 11 and the second patch antennas 12 are alternately arranged in the X direction.

That is, the plurality of first patch antennas 11 is arranged linearly in one line, the plurality of second patch antennas 12 is formed in a line different from the plurality of first patch antennas 11, and is arranged linearly in one line in parallel with the plurality of first patch antennas 11, and the first patch antennas 11 and the second patch antennas 12 are alternately arranged with respect to the X direction in which the first patch antennas 11 and the second patch antennas 12 are arranged linearly.

Therefore, the first patch antennas 11 are arranged so as to be shifted in the X direction and the Y direction with respect to the second patch antennas 12. As a result, mutual coupling between the first patch antenna 11 and the second patch antenna 12 may be suppressed, and isolation may be enhanced.

Note that in the second embodiment, both the first patch antennas 11 and the second patch antennas 12 are arranged in straight lines in the X direction. The present disclosure is not limited to this, and for example, both the first patch antennas 11 and the second patch antennas 12 may be arranged in straight lines in the Y direction.

Figure 13:
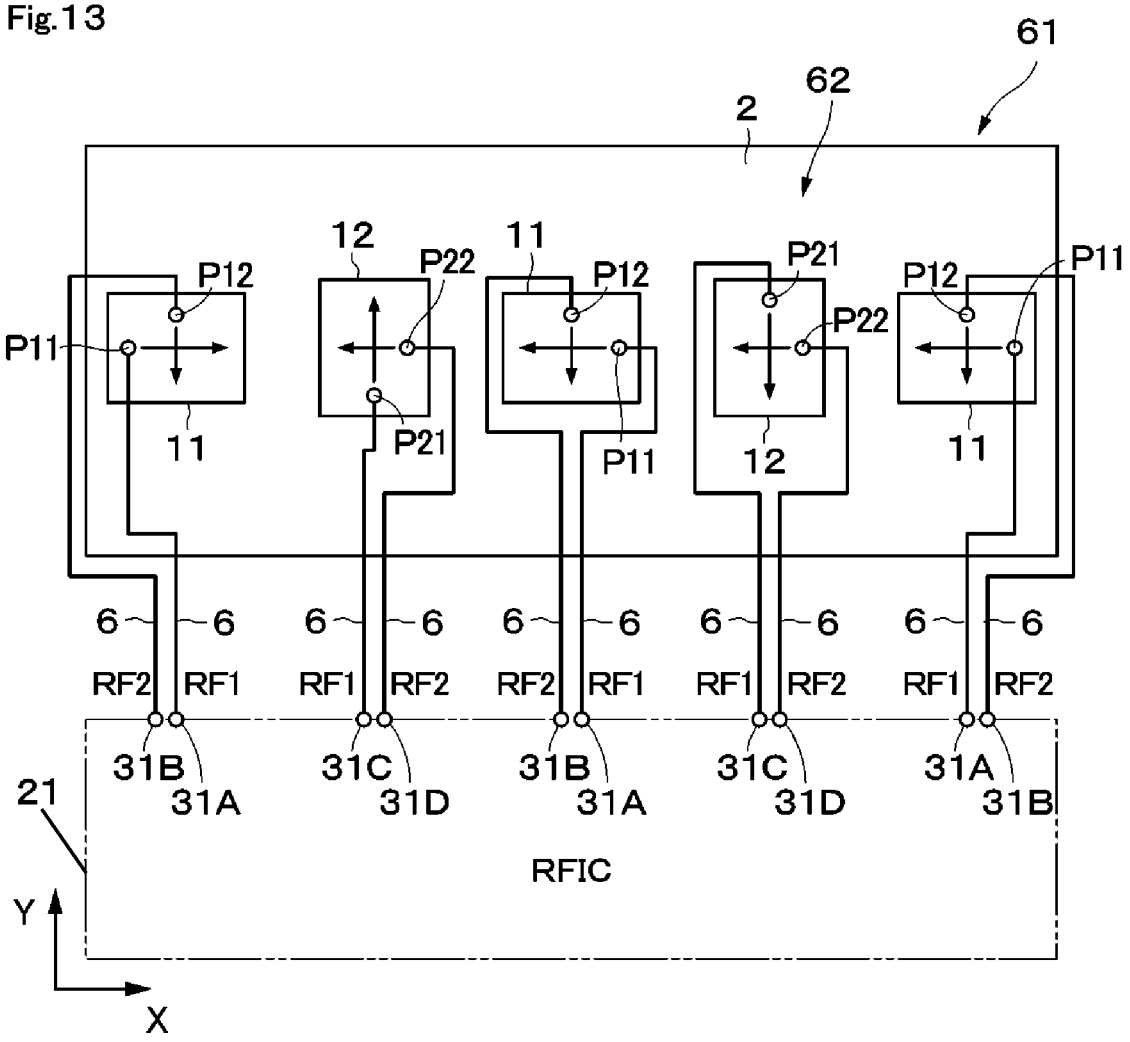
FIG. 13 is an overall configuration diagram illustrating a radio frequency module according to a third embodiment of the present disclosure.
Figure 14:
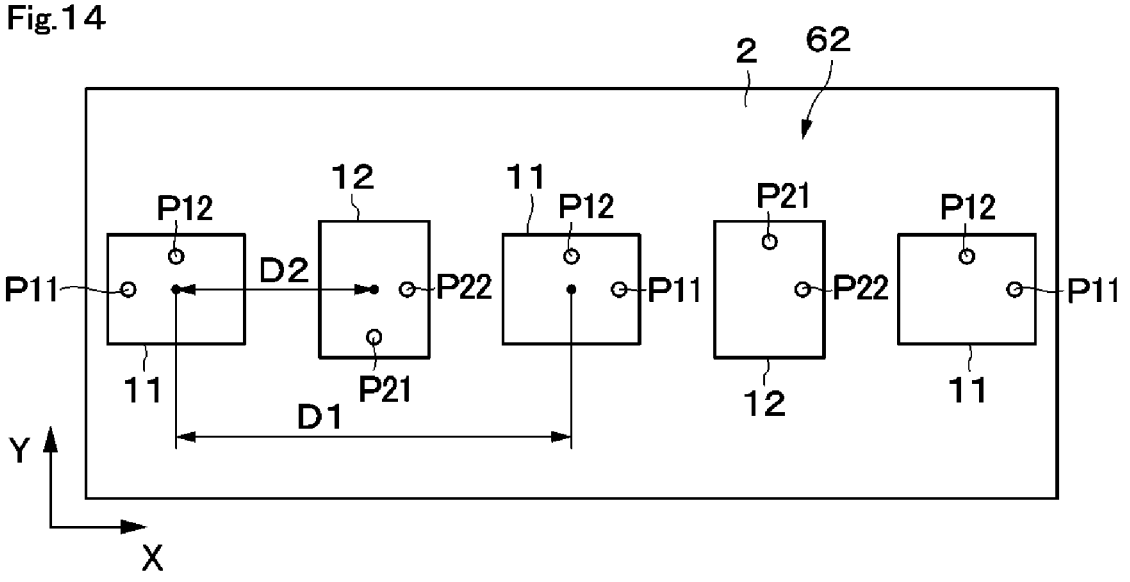
FIG. 14 is a plan view illustrating an array antenna in FIG. 13.

Next, FIG. 13 and FIG. 14 illustrate a third embodiment of the present disclosure. A feature of the third embodiment is in that a plurality of first patch antennas and a plurality of second patch antennas are alternately arranged in one straight line in the X direction. In the third embodiment, the similar constituent elements as those in the first embodiment are denoted by the same reference signs, and the description thereof will not be repeated.

FIG. 13 illustrates a radio frequency module 61 according to the third embodiment of the present disclosure. The radio frequency module 61 includes the multilayer dielectric substrate 2 to be described later, an array antenna 62, the RFIC 21, and the like.

Three first patch antennas 11 are arranged linearly with respect to the X direction. Two second patch antennas 12 are arranged linearly with respect to the X direction. The three first patch antennas 11 and the two second patch antennas 12 are arranged in one straight line in the X direction. The first patch antennas 11 and the second patch antennas 12 are alternately arranged in the X direction. Therefore, the second patch antenna 12 is sandwiched between two first patch antennas 11. Therefore, when a distance between any one of the first patch antennas 11 and another one of the first patch antennas 11 closest to the any one first patch antenna 11 is defined as D1, and a distance between any one of the patch antennas 11 and the second patch antenna 12 closest to the any one first patch antenna 11 is defined as D2, D1>D2 is satisfied (see FIG. 14).

As illustrated in FIG. 13 and FIG. 14, three first patch antennas 11 and two second patch antennas 12 configure an array antenna 62.

Thus, also in the third embodiment configured as described above, substantially similar operational effects as those of the first embodiment described above may be obtained.

Figure 15:
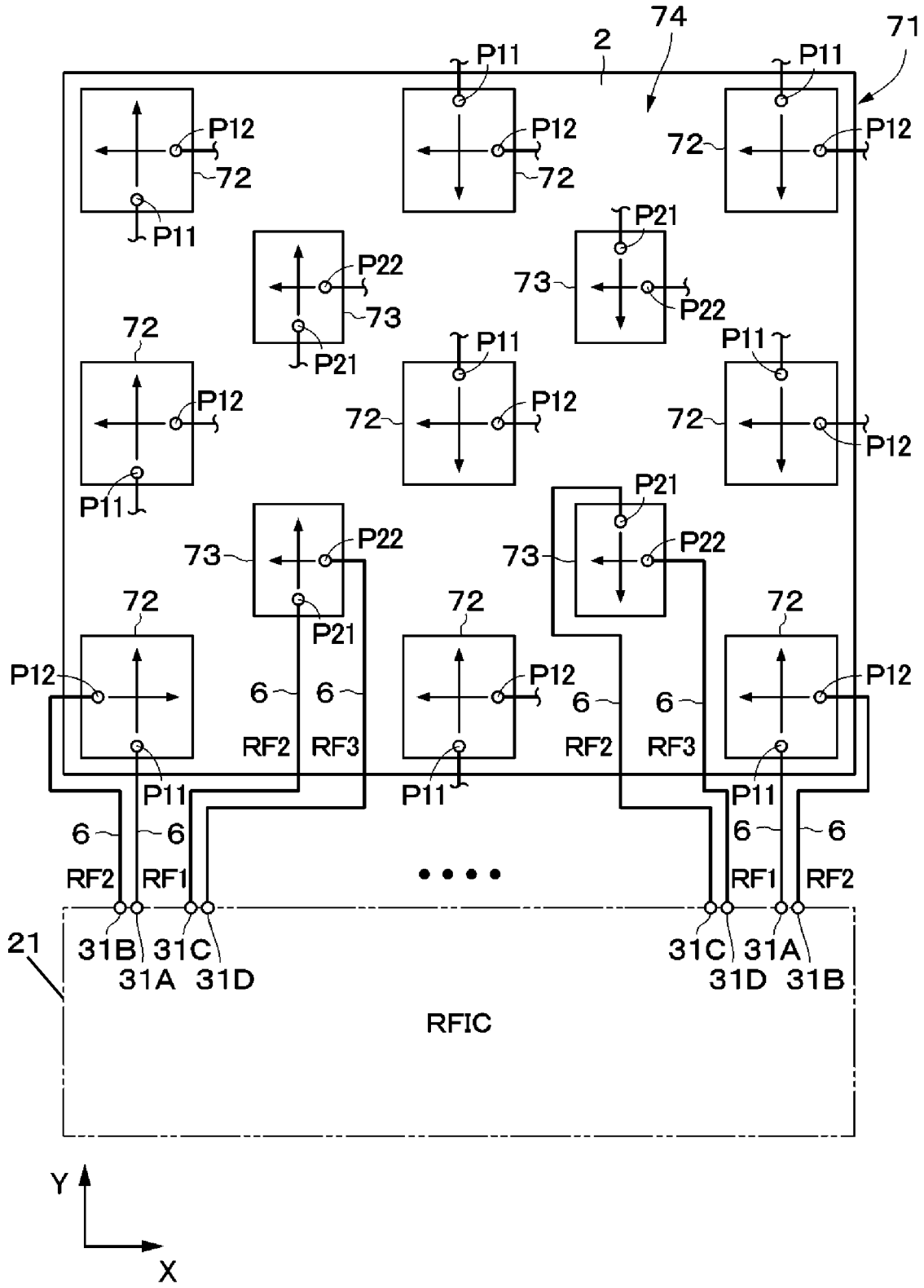
FIG. 15 is an overall configuration diagram illustrating a radio frequency module according to a fourth embodiment of the present disclosure.
Figure 16:
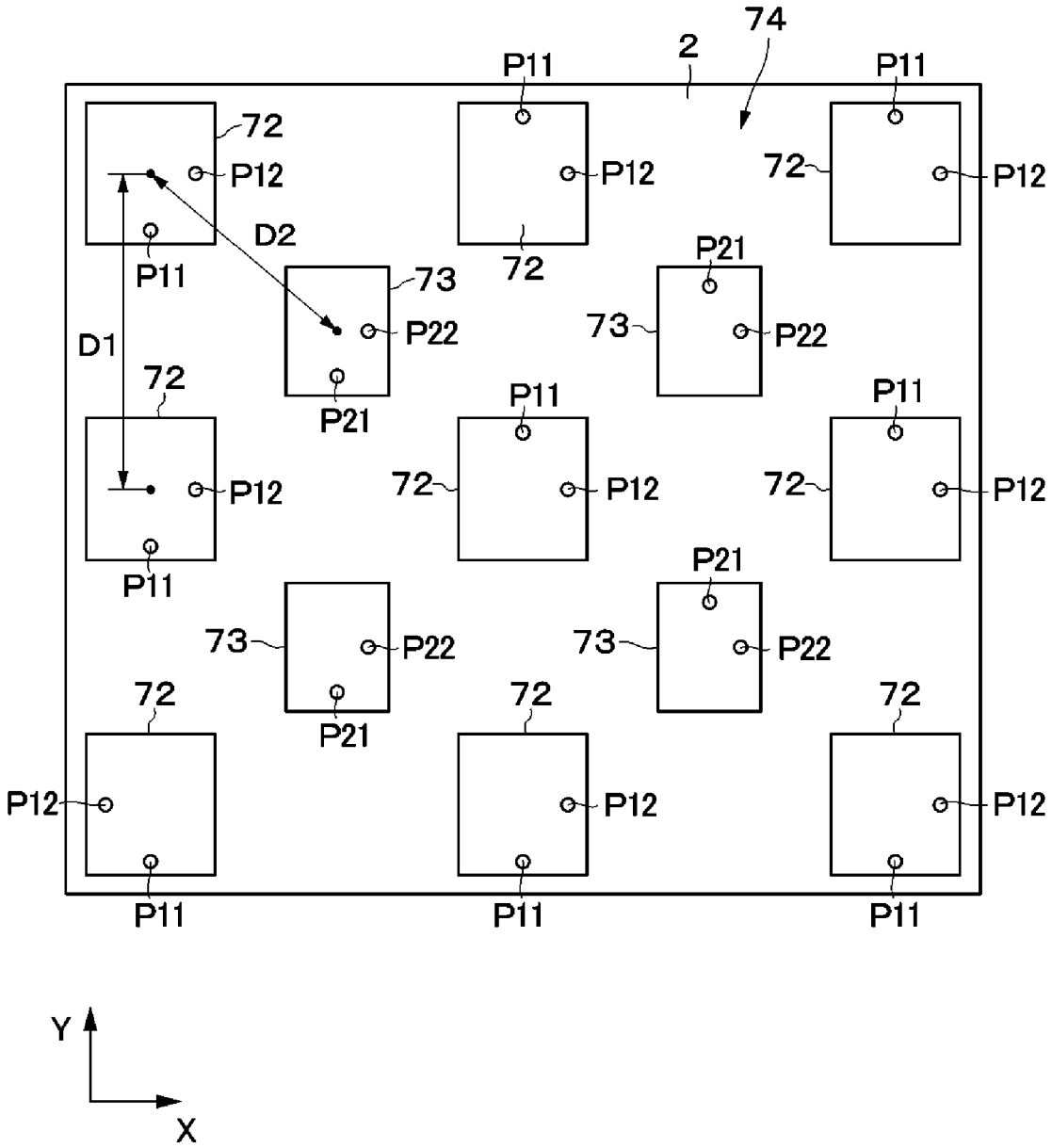
FIG. 16 is a plan view illustrating an array antenna in FIG. 15.
Figure 17:
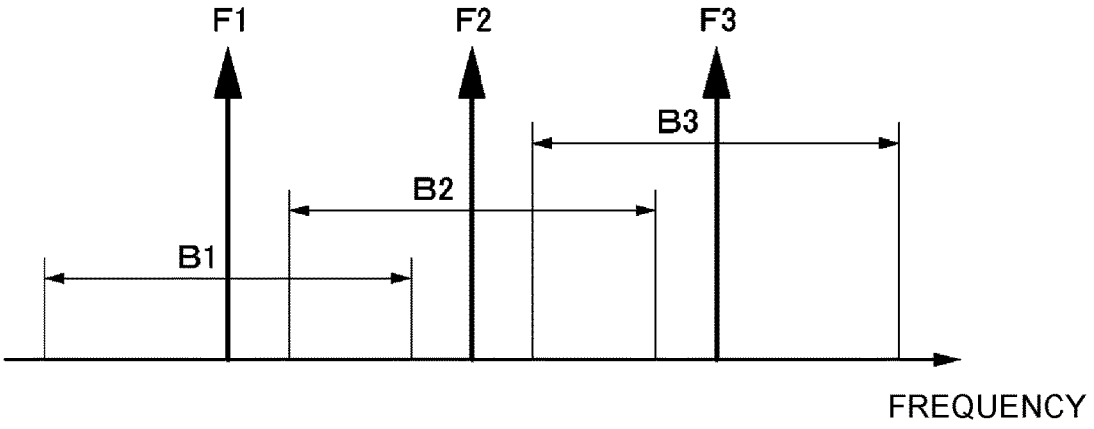
FIG. 17 is an explanatory diagram illustrating a relationship among an operating band of a first operating frequency, an operating band of a second operating frequency, and an operating band of a third operating frequency.

Next, FIG. 15 to FIG. 17 illustrate a fourth embodiment of the present disclosure. A feature of the fourth embodiment is in that a radio frequency module includes a plurality of first polarized wave sharing antennas which radiates a polarized wave in a Y direction at a first operating frequency and radiates a polarized wave in an X direction at a second operating frequency which is higher than the first operating frequency, and a plurality of second polarized wave sharing antennas which radiates a polarized wave in the X direction at a third operating frequency which is different from the first operating frequency and the second operating frequency and radiate the polarized wave in the Y direction at the second operating frequency. In the fourth embodiment, the similar constituent elements as those in the first embodiment are denoted by the same reference signs, and the description thereof will not be repeated.

FIG. 15 and FIG. 16 illustrate a radio frequency module 71 according to the fourth embodiment of the present disclosure. The radio frequency module 71 includes the multilayer dielectric substrate 2 to be described later, an array antenna 74, the RFIC 21, and the like.

A length dimension in the Y direction of a first patch antenna 72 is set to a value which is a half wave length of a first radio frequency signal RF1, for example, in terms of electrical length. On the other hand, a length dimension in the X direction of the first patch antenna 72 is set to a value which is a half wave length of a second radio frequency signal RF2, for example, in terms of electrical length.

In this case, the second operating frequency of the second radio frequency signal RF2 is higher than the first operating frequency of the first radio frequency signal RF1. That is, a center frequency F2 of the second operating frequency is higher than a center frequency F1 of the first operating frequency (F2>F1). Therefore, the first patch antenna 72 is formed in a rectangular shape in which the length dimension in the X direction is shorter than the length dimension in the Y direction.

Thus, the first patch antenna 72 radiates a polarized wave in the Y direction (vertically polarized wave) at the first operating frequency having a predetermined operating band B1. In addition, the first patch antenna 72 radiates a polarized wave in the X direction (horizontally polarized wave) at the second operating frequency having a predetermined operating band B2. Note that the operating band B1 of the first operating frequency and the operating band B2 of the second operating frequency overlap each other on the frequency axis (see FIG. 17).

The first patch antenna 72 has a first feeding point P11 to which the via 8 is connected at an intermediate position in the Y direction which is shifted from the center (see FIG. 15 and FIG. 16). On the other hand, the first patch antenna 72 has a second feeding point P12 to which the via 8 is connected at an intermediate position in the X direction which is shifted from the center.

A length dimension in the Y direction of a second patch antenna 73 is set to a value which is the half wave length of the second radio frequency signal RF2 (center frequency F2), for example, in terms of electrical length. On the other hand, a length dimension in the X direction of the second patch antenna 73 is set to a value which is a half wave length of a third radio frequency signal RF3 (center frequency F3), for example, in terms of electrical length.

In this case, the third operating frequency of the third radio frequency signal RF3 is higher than the second operating frequency of the second radio frequency signal RF2. That is, a center frequency F3 of the third operating frequency is higher than the center frequency F2 of the second operating frequency (F3>F2). Therefore, the second patch antenna 73 is formed in a rectangular shape in which the length dimension in the X direction is shorter than the length dimension in the Y direction.

Thus, the second patch antenna 73 radiates a polarized wave in the Y direction (vertically polarized wave) at the second operating frequency having the operating band B2. In addition, the second patch antenna 73 radiates a polarized wave in the X direction (horizontally polarized wave) at the third operating frequency having the operating band B3. The operating band B2 of the second operating frequency and the operating band B3 of the third operating frequency overlap each other on the frequency axis (refer to FIG. 17).

The second patch antenna 73 has a first feeding point P21 to which the via 8 is connected at an intermediate position in the Y direction which is shifted from the center (see FIG. 15 and FIG. 16). On the other hand, the second patch antenna 73 has a second feeding point P22 to which the via 8 is connected at an intermediate position in the X direction which is shifted from the center.

The first patch antennas 72 and the second patch antennas 73 are placed in or on the multilayer dielectric substrate 2 at the same positions as the first patch antennas 11 and the first patch antennas 12 according to the first embodiment, for example. That is, nine first patch antennas 72 and four second patch antennas 73 are arranged on the multilayer dielectric substrate 2 in a staggered manner (at alternate positions). For this reason, when a distance between any one of the first patch antennas 72 and another one of the first patch antennas 72 closest to the any one first patch antenna 72 is defined as D1, and a distance between any one of the first patch antennas 72 and the second patch antenna 73 closest to the any one first patch antenna 72 is defined as D2, D1>D2 is satisfied (see FIG. 16).

As illustrated in FIG. 15 and FIG. 16, nine first patch antennas 72 and four second patch antennas 73 configure the array antenna 74.

Thus, also in the fourth embodiment configured as described above, substantially similar operational effects as those of the first embodiment described above may be obtained. In addition, the first patch antenna 72 and the second patch antenna 73 may radiate radio waves of three frequencies, that is, the first operating frequency (first radio frequency signal RF1), the second operating frequency (second radio frequency signal RF2), and the third operating frequency (third radio frequency signal RF3). Therefore, a frequency band (operating band) may be widened, compared to a case where a radio wave of only one frequency is radiated.

Further, the first patch antenna 72 radiates a polarized wave in the X direction (horizontally polarized wave) at the second operation frequency, and the second patch antenna 73 radiates a polarized wave in the Y direction (vertically polarized wave) at the second operating frequency. Therefore, by using the first patch antenna 72 and the second patch antenna 73, polarized waves in two directions that are the X direction and the Y direction may be radiated at the second operating frequency.

Figure 18:
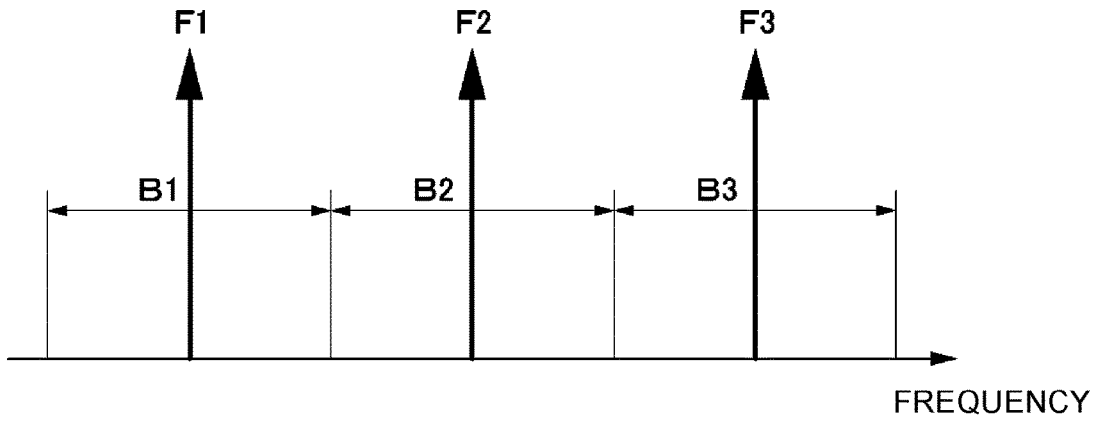
FIG. 18 is an explanatory diagram illustrating a relationship between an operating band of a first operating frequency, an operating band of a second operating frequency, and an operating band of a third operating frequency according to a third modification.

In the fourth embodiment, the operating band B1 of the first operating frequency and the operating band B2 of the second operating frequency overlap each other on the frequency axis, and the operating band B2 of the second operating frequency and the operating band B3 of the third operating frequency overlap each other on the frequency axis. The present disclosure is not limited to this, and as in a third modification illustrated in FIG. 18, the operating band B1 of the first operating frequency and the operating band B2 of the second operating frequency may be adjacent to each other on the frequency axis, and the operating band B2 of the second operating frequency and the operating band B3 of the third operating frequency may be adjacent to each other on the frequency axis.

Figure 19:
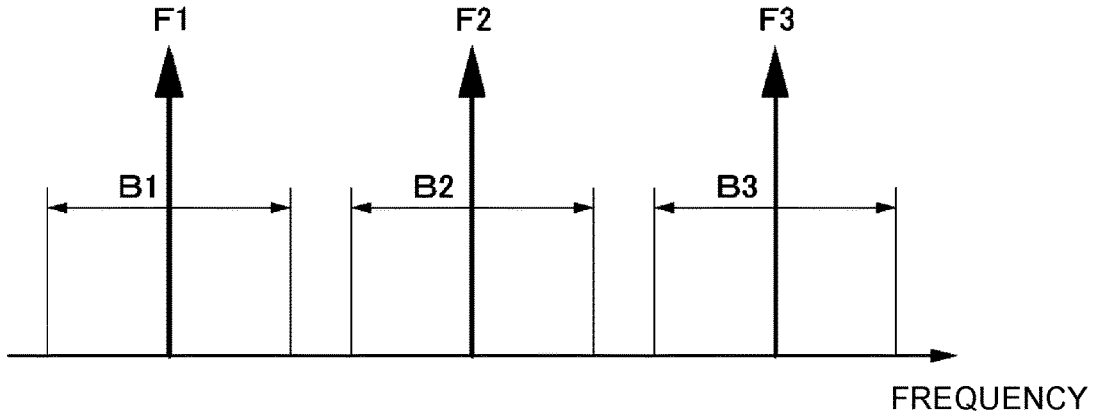
FIG. 19 is an explanatory diagram illustrating a relationship and an operating band of a first operating frequency, an operating band of a second operating frequency, and an operating band of a third operating frequency according to a fourth modification.

Also, as in a fourth modification illustrated in FIG. 19, the operating band B1 of the first operating frequency and the operating band B2 of the second operating frequency may be spaced apart from each other on the frequency axis, and the operating band B2 of the second operating frequency and the operating band B3 of the third operating frequency may be spaced apart from each other on the frequency axis.

Further, the operating band B1 of the first operating frequency and the operating band B2 of the second operating frequency may overlap each other on the frequency axis, and the operating band B2 of the second operating frequency and the operating band B3 of the third operating frequency may be adjacent to or spaced apart from each other on the frequency axis. The operating band B1 of the first operating frequency and the operating band B2 of the second operating frequency may be adjacent to or spaced apart from each other on the frequency axis, and the operating band B2 of the second operating frequency and the operating band B3 of the third operating frequency may overlap each other on the frequency axis.

In the fourth embodiment, it is assumed that the third operating frequency is higher than the second operating frequency. The present disclosure is not limited to this, and for example, the third operating frequency may be lower than the first operating frequency. In this case, the operating band of the third operating frequency may overlap the operating band of the first operating frequency, may be adjacent to the operating band of the first operating frequency, and may be spaced apart from the operating band of the first operating frequency.

Also, the third operating frequency may be a frequency between the first operating frequency and the second operating frequency. In this case, the operating band of the third operating frequency may overlap the operating bands of the first operating frequency and the second operating frequency, may be adjacent to the operating bands of the first operating frequency and the second operating frequency, and may be spaced apart from the operating bands of the first operating frequency and the second operating frequency. That is, the operating bands of the first operating frequency, the second operating frequency, and the third operating frequency may have any relationship among an overlap relationship, an adjacent relationship, and a spaced relationship.

Figure 20:
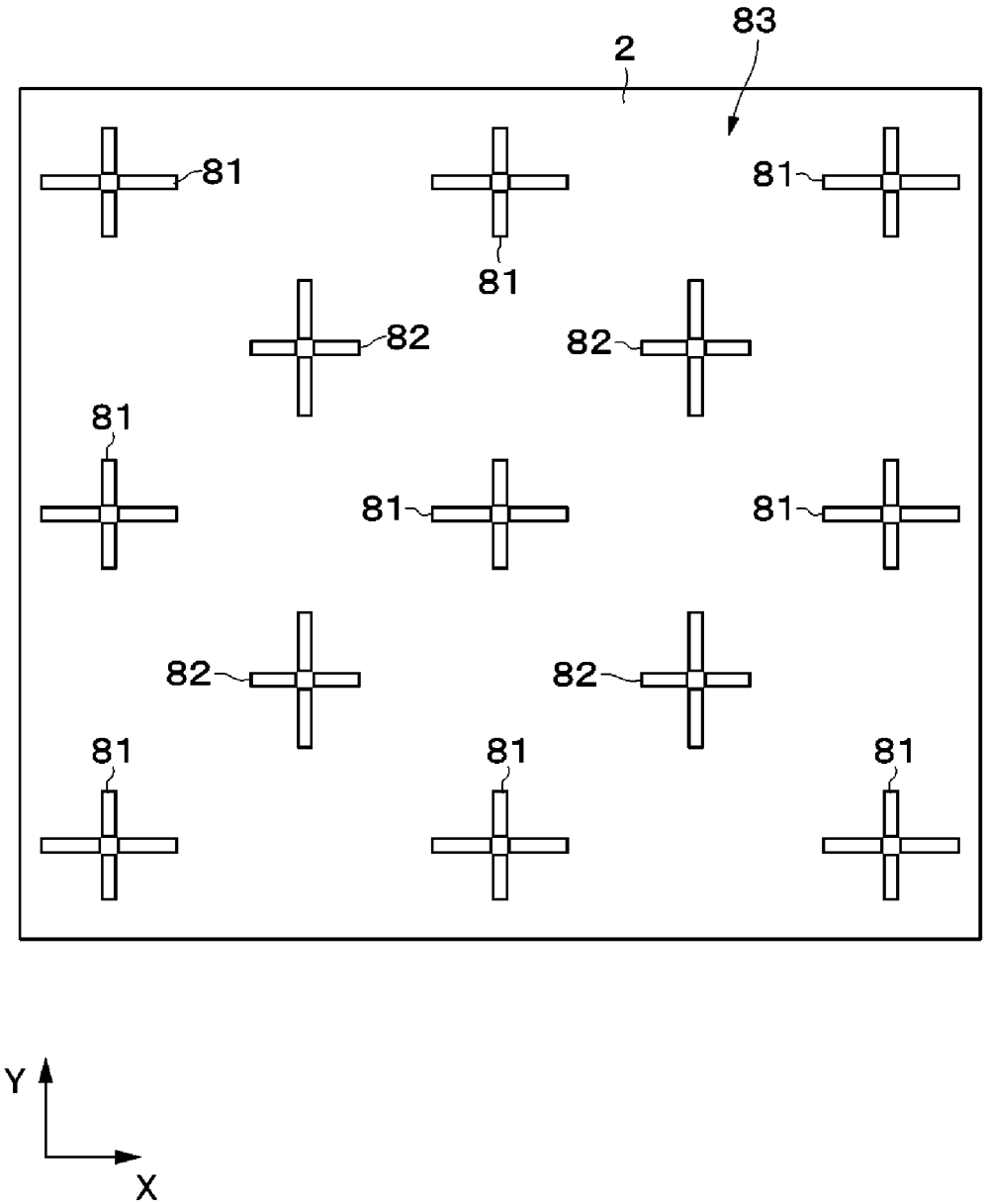
FIG. 20 is a plan view illustrating an array antenna according to a fifth modification.
Figure 21:
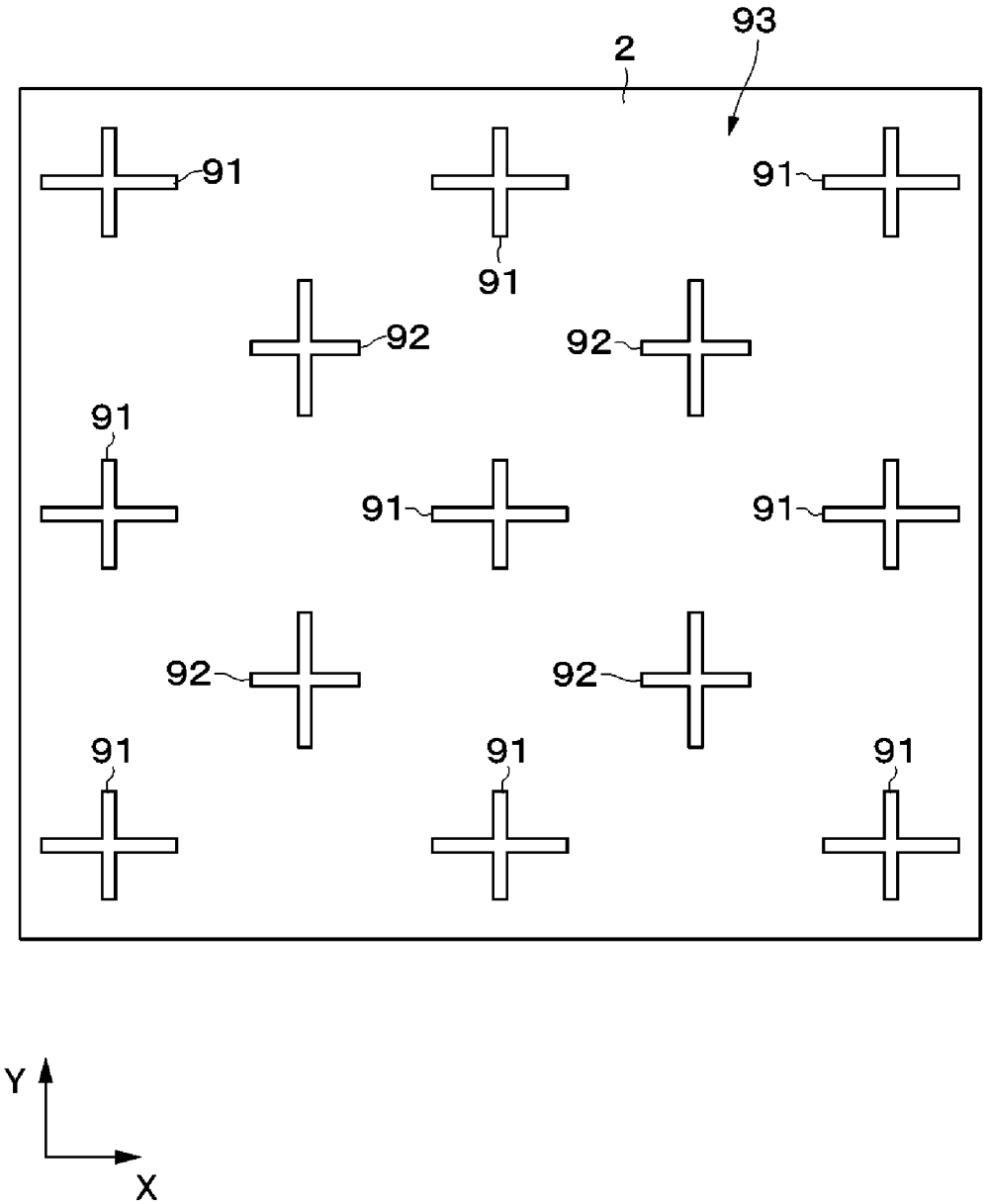
FIG. 21 is a plan view illustrating an array antenna according to a sixth modification.

In each of the embodiments described above, the first patch antenna 11 or 72 and the second patch antenna 12 or 73 configure the first polarized wave sharing antenna and the second polarized wave sharing antenna. The present disclosure is not limited to this, and a polarized wave sharing antenna may be configured by using a circular, elliptical or polygonal patch antenna. Further, as in a fifth modification illustrated in FIG. 20, each of a first polarized wave sharing antenna 81 and a second polarized wave sharing antenna 82 may be configured by two dipole antennas intersecting each other in a cross shape. In the fifth modification illustrated in FIG. 20, nine first polarized wave sharing antennas 81 and four second polarized wave sharing antennas 82 configure an array antenna 83. Further, as in a sixth modification illustrated in FIG. 21, each of the first polarized wave sharing antenna 91 and the second polarized wave sharing antenna 92 may be configured by using a slot antenna intersecting in a cross shape. In the sixth modification illustrated in FIG. 21, nine first polarized wave sharing antennas 91 and four second polarized wave sharing antennas 92 configure an array antenna 93.

The first embodiment has been described by exemplifying a case where the array antenna 13 has nine first patch antennas 11 and four second patch antennas 12. The present disclosure is not limited thereto, and the number of the first patch antennas 11 may be two to eight, or be equal to or more than ten. Similarly, the number of the second patch antennas 12 may be two, three, or be equal to or more than five. Further, the number of the first patch antennas 11 and the number of the second patch antennas 12 may be the same or different. This point may also be applied to the second embodiment to the fourth embodiment.

In each of the embodiments described above, the RFIC 21 includes the power amplifiers 23AT to 23DT, the variable phase shifters 26A to 26D, and the low noise amplifiers 23AR to 23DR. The present disclosure is not limited to this, and the RFIC 21 may include a transmission circuit and a reception circuit in addition to the power amplifiers 23AT to 23DT, the variable phase shifters 26A to 26D, and the low noise amplifiers 23AR to 23DR.

In the embodiments described above, as an example, a case has been described in which a microstrip line is used as the feeder line 6, but other feeder lines such as a strip line, a coplanar line, a coaxial cable, or the like, may be used.

Further, in the above embodiments, the radio frequency module 1 to be used for a millimeter wave in a 60 GHz band has been described as an example. The present disclosure is not limited to this, and may be applied to a radio frequency module to be used for a millimeter wave in another band, for example, or may be applied to a radio frequency module to be used for a microwave.

Further, specific numerical values such as the frequencies described in the above embodiments are given by way of an example, and are not limited to the exemplified values. These values are appropriately set according to the specifications of an object to be applied, for example.

It goes without saying that the above embodiments are merely examples, and that the partial replacement or combination of the configurations described in the different embodiments is possible.

Next, the disclosure included in the above embodiments will be described. The present disclosure provides a radio frequency module including a multilayer dielectric substrate, an RFIC connected to the multilayer dielectric substrate and having a plurality of RF input/output terminals connected to the multilayer dielectric substrate, and an array antenna placed in or on the multilayer dielectric substrate and configured with a plurality of polarized wave sharing antennas configured to radiate polarized waves in X and Y directions orthogonal to each other, in which the RFIC includes at least a switching unit for switching ON and OFF states of input or output of an RF signal and a variable phase shifter for each of the plurality of RF input/output terminals, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a polarized wave in the X direction at a first operating frequency and configured to radiate a polarized wave in the Y direction at a second operating frequency higher than the first operating frequency, and a plurality of second polarized wave sharing antennas configured to radiate a polarized wave in the Y direction at the first operating frequency and configured to radiate a polarized wave in the X direction at the second operating frequency, and when a distance between any one of the first polarized wave sharing antennas and another one of the first polarized wave sharing antennas closest to the any one first polarized wave sharing antenna is defined as D1, and a distance between any one of the first polarized wave sharing antennas and the second polarized wave sharing antenna closest to the any one first polarized wave sharing antenna is defined as D2, D1>D2 is satisfied.

According to the present disclosure, both the first polarized wave sharing antenna and the second polarized wave sharing antenna may radiate radio waves of two frequencies, that is, the first operating frequency and the second operating frequency. Therefore, the frequency band may be widened, compared to a case where a radio wave of only one frequency is radiated.

Also, the first polarized wave sharing antenna radiates a polarized wave in the X direction at the first operating frequency, and the second polarized wave sharing antenna radiates a polarized wave in the Y direction at the first operating frequency. Therefore, by using the first polarized wave sharing antenna and the second polarized wave sharing antenna, polarized waves in two directions, that is, in the X direction and the Y direction may be radiated at the first operating frequency. In addition, the first polarized wave sharing antenna radiates a polarized wave in the Y direction at the second operating frequency, and the second polarized wave sharing antenna radiates a polarized wave in the X direction at the second operating frequency. Therefore, by using the first polarized wave sharing antenna and the second polarized wave sharing antenna, polarized waves in two directions, that is, in the X direction and the Y direction may be radiated at the second operating frequency. As a result, the first polarized wave sharing antenna and the second polarized wave sharing antenna may radiate radio waves of polarized waves in two directions at two frequencies.

The plurality of first polarized wave sharing antennas and the plurality of second polarized wave sharing antennas are connected to the RFIC having the variable phase shifter for each of the plurality of RF input/output terminals. Therefore, the plurality of first polarized wave sharing antennas and the plurality of second polarized wave sharing antennas may operate as a phased array.

The present disclosure includes a radio frequency module including a multilayer dielectric substrate, an RFIC connected to the multilayer dielectric substrate and having a plurality of RF input/output terminals, and an array antenna placed in or on the multilayer dielectric substrate and configured with a plurality of polarized wave sharing antennas configured to radiate polarized waves in X and Y directions orthogonal to each other, in which the RFIC includes at least a switching unit for switching ON and off states of input or output of an RF signal and a variable phase shifter for each of the plurality of RF input/output terminals, two of the plurality of RF input/output terminals are connected to each of the plurality of polarized wave sharing antennas at feeding points corresponding to polarized waves orthogonal to each other, and the plurality of polarized wave sharing antennas includes a plurality of first polarized wave sharing antennas configured to radiate a polarized wave in the Y direction at a first operating frequency and configured to radiate a polarized wave in the X direction at a second operating frequency higher than the first operating frequency, and a plurality of second polarized wave sharing antennas configured to radiate a polarized wave in the X direction at a third operating frequency different from the first operating frequency and the second operating frequency and configured to radiate a polarized wave in the Y direction at the second operating frequency.

According to the present disclosure, the first polarized wave sharing antenna and the second polarized wave sharing antenna may radiate radio waves of three frequencies, that is, the first operating frequency, the second operating frequency, and the third operating frequency. Therefore, the frequency band (operating band) may be widened, compared to a case where a radio wave of only one frequency is radiated.

Also, the first polarized wave sharing antenna radiates a polarized wave in the X direction (horizontally polarized wave) at the second operating frequency, and the second polarized wave sharing antenna radiates a polarized wave in the Y direction (vertically polarized wave) at the second operating frequency. Therefore, by using the first polarized wave sharing antenna and the second polarized wave sharing antenna, polarized waves in two directions, that is, in the X direction and the Y direction may be radiated at the second operating frequency.

The plurality of first polarized wave sharing antennas and the plurality of second polarized wave sharing antennas are connected to the RFIC having the variable phase shifter for each of the plurality of RF input/output terminals. Therefore, the plurality of first polarized wave sharing antennas and the plurality of second polarized wave sharing antennas may operate as a phased array.

A feature of the present disclosure is in that an operating band of the third operating frequency and an operating band of the first operating frequency or the second operating frequency overlap each other on a frequency axis. By using the first polarized wave sharing antenna and the second polarized wave sharing antenna, communication may be performed in a continuous band covering the first operating frequency, the second operating frequency, and the third operating frequency.

A feature of the present disclosure is in that an operating band of the third operating frequency and an operating band of the first operating frequency or the second operating frequency are adjacent to each other on a frequency axis. Thus, the operating band that is usable may be widened.

A feature of the present disclosure is in that the operating band of the third operating frequency and the operating bands of the first operating frequency and the second operating frequency are spaced apart from each other on a frequency axis. Thus, isolation may be ensured between the operating band of the third operating frequency and the operating bands of the first operating frequency and the second operating frequency.

A feature of the present disclosure is in that the plurality of first polarized wave sharing antennas and the plurality of second polarized wave sharing antennas are arranged linearly in one line and are alternately arranged. Thus, an array antenna in which the first polarized wave sharing antennas and the second polarized wave sharing antennas are arranged in one line may be configured.

A feature of the present disclosure is in that the plurality of first polarized wave sharing antennas is arranged linearly in one line, the plurality of second polarized wave sharing antennas forms a line different from the one line of the plurality of first polarized wave sharing antennas, and is arranged linearly in one line in parallel with the one line of the plurality of first polarized wave sharing antennas, and the first polarized wave sharing antennas and the second polarized wave sharing antennas are alternately arranged with respect to a direction in which the first polarized wave sharing antennas and the second polarized wave sharing antennas are arranged linearly. Thus, an array antenna in which the first polarized wave sharing antennas and the second polarized wave sharing antennas are arranged in two lines may be configured.

A feature of the present disclosure is in that any one of the first polarized wave sharing antennas is surrounded by four of the second polarized wave sharing antennas and is arranged at a center position of these four of the second polarized wave sharing antennas.

According to the present disclosure, one first polarized wave sharing antennas is surrounded by four second polarized wave sharing antennas arranged in a matrix shape, and is arranged at the center position of the four second polarized wave sharing antennas. Therefore, a first polarized wave sharing antenna is arranged so as to be shifted in the X direction and the Y direction with respect to four second polarized wave sharing antennas located around the first polarized wave sharing antenna. Accordingly, mutual coupling between the first polarized wave sharing antenna and the second polarized wave sharing antenna may be suppressed, and isolation may be enhanced.

The present disclosure provides a radio frequency module including a multilayer dielectric substrate, an RFIC connected to the multilayer dielectric substrate and having a plurality of RF input/output terminals, and an array antenna placed in or on the multilayer dielectric substrate and configured with a plurality of polarized wave sharing antennas configured to radiate polarized waves in X and Y directions orthogonal to each other, in which the RFIC includes at least a switching unit configured to switch ON and OFF states of input or output of an RF signal and a variable phase shifter for each of the plurality of RF input/output terminals, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a polarized wave in the X direction at a first operating frequency and configured to radiate a polarized wave in the Y direction at a second operating frequency higher than the first operating frequency, and a plurality of second polarized wave sharing antennas configured to radiate a polarized wave in the Y direction at the first operating frequency and configured to radiate a polarized wave in the X direction at the second operating frequency, the first polarized wave sharing antennas are arranged linearly such that each two of the first polarized wave sharing antennas adjacent to each other in one direction of the X and Y directions have an interval equal to or shorter than a free space wave length with respect to the second operating frequency, the second polarized wave sharing antennas are spaced apart from the plurality of first polarized wave sharing antennas arranged linearly at a fixed interval in the other direction orthogonal to the one direction, and are arranged linearly such that each two of the second polarized wave sharing antennas adjacent to each other in the one direction have an interval equal to or shorter than the free space wave length with respect to the second operating frequency, and the first polarized wave sharing antennas and the second polarized wave sharing antennas are alternately arranged in the one direction.

According to the present disclosure, both the first polarized wave sharing antenna and the second polarized wave sharing antenna may radiate radio waves of two frequencies, that is, the first operating frequency and the second operating frequency. Therefore, the frequency band may be widened, compared to a case where a radio wave of only one frequency is radiated.

By using the first polarized wave sharing antenna and the second polarized wave sharing antenna, polarized waves in two directions, that is, in the X direction and the Y direction may be radiated at the first operating frequency. In addition, by using the first polarized wave sharing antenna and the second polarized wave sharing antenna, polarized waves in two directions, that is, in the X direction and the Y direction may be radiated at the second operating frequency. As a result, the first polarized wave sharing antenna and the second polarized wave sharing antenna may radiate radio waves of polarized waves in two directions at two frequencies.

Also, the plurality of first polarized wave sharing antennas is arranged linearly in one direction. Further, the plurality of second polarized wave sharing antennas is spaced apart from the plurality of first polarized wave sharing antennas in the other direction orthogonal to the one direction at a fixed interval and is arranged linearly in one direction. In addition, the first polarized wave sharing antennas and the second polarized wave sharing antennas are alternately arranged in one direction. Therefore, the first polarized wave sharing antennas are arranged to be shifted in the X direction and the Y direction with respect to the second polarized wave sharing antennas. Accordingly, mutual coupling between the first polarized wave sharing antenna and the second polarized wave sharing antenna may be suppressed, and isolation may be enhanced.

The plurality of first polarized wave sharing antennas and the plurality of second polarized wave sharing antennas are connected to the RFIC having the variable phase shifter for each of the plurality of RF input/output terminals. Therefore, the plurality of first polarized wave sharing antennas and the plurality of second polarized wave sharing antennas may operate as a phased array.

A feature of the present disclosure is in that an operating band of the first operating frequency and an operating band of the second operating frequency overlap each other on a frequency axis. Accordingly, by using the first polarized wave sharing antenna and the second polarized wave sharing antenna, communication may be performed in a continuous band covering the first operating frequency and the second operating frequency.

A feature of the present disclosure is in that an operating band of the first operating frequency and an operating band of the second operating frequency are adjacent to each other on a frequency axis. Thus, the operating band that is usable may be widened.

A feature of the present disclosure is in that an operating band of the first operating frequency and an operating band of the second operating frequency are spaced apart from each other on a frequency axis. Thus, isolation may be secured between the operating band of the first operating frequency and the operating band of the second operating frequency.

A feature of the present disclosure is in that when a 60 GHz band is divided into seven channels to perform communication, an operating band of the first operating frequency corresponds to four channels on a low frequency side of the seven channels, and an operating band of the second operating frequency corresponds to four channels on a high frequency side of the seven channels.

According to the present disclosure, for example, when performing communication by using the four channels on the low frequency side, the first polarized wave sharing antenna and the second polarized wave sharing antenna radiate radio waves of the first operating frequency. In this case, it is not necessary to radiate radio waves of a plurality of frequencies. Therefore, when a channel is switched, frequency switching from the first operating frequency to the second operating frequency is unnecessary. On the other hand, when communication is performed by using the seven channels, the first polarized wave sharing antenna and the second polarized wave sharing antenna radiate radio waves of the second operating frequency in addition to radiating radio waves of the first operating frequency.

In the present disclosure, the RFIC is connected to a baseband IC. The radio frequency module according to the present disclosure configures a communication device.

1, 51, 61, 71 RADIO FREQUENCY MODULE
2 MULTILAYER DIELECTRIC SUBSTRATE
6 FEEDER LINE
11, 72 FIRST PATCH ANTENNA (FIRST POLARIZED WAVE SHARING ANTENNA)
12, 73 SECOND PATCH ANTENNA (SECOND POLARIZED WAVE SHARING ANTENNA)
13, 42, 74, 83, 93 ARRAY ANTENNA
21 RFIC
22A TO 22D, 24A TO 24D, 28 SWITCH (SWITCHING UNIT)
26A TO 26D VARIABLE PHASE SHIFTER
31A TO 31D RF INPUT/OUTPUT TERMINAL
41 BASEBAND IC (BBIC)
81, 91 FIRST POLARIZED WAVE SHARING ANTENNA
82, 92 SECOND POLARIZED WAVE SHARING ANTENNA
101 COMMUNICATION DEVICE

The invention claimed is:

1. A radio frequency module comprising:

a multilayer dielectric substrate;

an RFIC connected to the multilayer dielectric substrate and having a plurality of RF input/output terminals; and an array antenna placed on or in the multilayer dielectric substrate and configured with a plurality of polarized wave sharing antennas configured to radiate polarized waves in an X direction and a Y direction, the X direction and the Y direction being orthogonal to each other, wherein the RFIC includes, for each of the plurality of RF input/output terminals, a switching unit for switching ON and OFF states of input or output of an RF signal, and a variable phase shifter, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a first polarized wave in the X direction at a first operating frequency and configured to radiate a second polarized wave in the Y direction at a second operating frequency higher than the first operating frequency, and a plurality of second polarized wave sharing antennas configured to radiate a third polarized wave in the Y direction at the first operating frequency and configured to radiate a fourth polarized wave in the X direction at the second operating frequency, and when a distance between any one of the first polarized wave sharing antennas and another one of the first polarized wave sharing antenna closest to the any one of the first polarized wave sharing antennas is defined as D1, and a distance between any one of the first polarized wave sharing antennas and the second polarized wave sharing antenna closest to the any one of the first polarized wave sharing antennas is defined as D2, a condition D1>D2 is satisfied.

2. A radio frequency module comprising:

a multilayer dielectric substrate;

an RFIC connected to the multilayer dielectric substrate and having a plurality of RF input/output terminals; and an array antenna placed in or on the multilayer dielectric substrate and configured with a plurality of polarized wave sharing antennas configured to radiate polarized waves in X and Y directions orthogonal to each other, wherein the RFIC includes, for each of the plurality of RF input/output terminals, a switching unit for switching ON and OFF states of input or output of an RF signal and a variable phase shifter, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a first polarized wave in the Y direction at a first operating frequency and configured to radiate a second polarized wave in the X direction at a second operating frequency higher than the first operating frequency, and a plurality of second polarized wave sharing antennas configured to radiate a third polarized wave in the X direction at a third operating frequency different from the first operating frequency and the second operating frequency and configured to radiate a fourth polarized wave in the Y direction at the second operating frequency.

3. The radio frequency module according to claim 2, wherein an operating band of the third operating frequency and an operating band of the first operating frequency or the second operating frequency overlap each other on a frequency axis.

4. The radio frequency module according to claim 2, wherein an operating band of the third operating frequency and an operating frequency of the first operating frequency or the second operating frequency are adjacent to each other on a frequency axis.

5. The radio frequency module according to claim 2, wherein an operating band of the third operating frequency and operating bands of the first operating frequency and the second operating frequency are spaced apart from each other on a frequency axis.

6. The radio frequency module according to claim 1, wherein the plurality of first polarized wave sharing antennas and the plurality of second polarized sharing antennas are arranged linearly in one line and are alternately arranged.

7. The radio frequency module according to claim 2, wherein the plurality of first polarized wave sharing antennas and the plurality of second polarized sharing antennas are arranged linearly in one line and are alternately arranged.

8. The radio frequency module according to claim 1, wherein the plurality of first polarized wave sharing antennas is arranged linearly in a first line, the plurality of second polarized wave sharing antennas forms a second line different from the first line, and is arranged linearly in the second line in parallel with the first line, and the first polarized wave sharing antennas and the second polarized wave sharing antennas are alternately arranged with respect to a direction in which the first polarized wave sharing antennas and the second polarized wave sharing antennas are arranged linearly.

9. The radio frequency module according to claim 2, wherein the plurality of first polarized wave sharing antennas is arranged linearly in a first line, the plurality of second polarized wave sharing antennas forms a second line different from the first line, and is arranged linearly in the second line in parallel with the first line, and the first polarized wave sharing antennas and the second polarized wave sharing antennas are alternately arranged with respect to a direction in which the first polarized wave sharing antennas and the second polarized wave sharing antennas are arranged linearly.

10. The radio frequency module according to claim 1, wherein any one of the first polarized wave sharing antennas is surrounded by four of the second polarized wave sharing antennas and is arranged at a center position of the four of the polarized wave sharing antennas.

11. The radio frequency module according to claim 2, wherein any one of the first polarized wave sharing antennas is surrounded by four of the second polarized wave sharing antennas and is arranged at a center position of the four of the polarized wave sharing antennas.

12. A radio frequency module comprising:

a multilayer dielectric substrate;

an RFIC connected to the multilayer dielectric substrate and having a plurality of RF input/output terminals; and an array antenna placed in or on the multilayer dielectric substrate and configured with a plurality of polarized wave sharing antennas configured to radiate polarized waves in X and Y directions orthogonal to each other, wherein the RFIC includes, for each of the plurality of RF input/output terminals, a switching unit for switching ON and OFF states of input or output of an RF signal and a variable phase shifter, two of the plurality of RF input/output terminals are connected to each of the plurality of polarized wave sharing antennas at feeding points corresponding to polarized waves orthogonal to each other, the plurality of polarized wave sharing antennas includes a plurality of first polarized wave sharing antennas configured to radiate a first polarized wave in the X direction at a first operating frequency and configured to radiate a second polarized wave in the Y direction at a second operating frequency higher than the first operating frequency, and a plurality of second polarized wave sharing antennas configured to a third polarized wave in the Y direction at the first operating frequency and configured to radiate a fourth polarized wave in the X direction at the second operating frequency, the first polarized wave sharing antennas are arranged linearly such that each two of the first polarized wave sharing antennas adjacent to each other in a first direction of the X and Y directions have an interval equal to or shorter than a free space wave length with respect to the second operating frequency, the second polarized wave sharing antennas are spaced apart from the plurality of first polarized wave sharing antennas arranged linearly at a fixed interval in a second direction of the X and Y directions orthogonal to the first direction, and are arranged linearly such that each two of the second polarized wave sharing antennas adjacent to each other in the first direction have an interval equal to or shorter than the free space wave length with respect to the second operating frequency, and the first polarized wave sharing antennas and the second polarized wave sharing antennas are alternately arranged in the first direction.

13. The radio frequency module according to claim 1, wherein an operating band of the first operating frequency and an operating band of the second operating frequency overlap each other on a frequency axis.

14. The radio frequency module according to claim 2, wherein an operating band of the first operating frequency and an operating band of the second operating frequency overlap each other on a frequency axis.

15. The radio frequency module according to claim 1, wherein an operating band of the first operating frequency and an operating band of the second operating frequency are adjacent to each other on a frequency axis.

16. The radio frequency module according to claim 1, wherein an operating band of the first operating frequency and an operating band of the second operating frequency are adjacent to each other on a frequency axis.

17. The radio frequency module according to claim 1, wherein an operating band of the first operating frequency and an operating band of the second operating frequency are spaced apart from each other on a frequency axis.

18. The radio frequency module according to claim 13, wherein when a 60 GHz band is divided into seven channels to perform communication, an operating band of the first operating frequency corresponds to four channels on a low frequency side of the seven channels, and an operating band of the second operating frequency corresponds to four channels on the high frequency side of the seven channels.

19. The radio frequency module according to claim 1, wherein the RFIC is connected to a baseband IC.

20. A communication device comprising:

the radio frequency module according to claim 19.

* * * * *